US011745088B1

(12) United States Patent
Appell

(10) Patent No.: US 11,745,088 B1
(45) Date of Patent: Sep. 5, 2023

(54) TRACTION PAD SYSTEM FOR SKATEBOARDS AND SURFBOARDS

(71) Applicant: Thomas Edward Appell, Coto De Caza, CA (US)

(72) Inventor: Thomas Edward Appell, Coto De Caza, CA (US)

( * ) Notice: Subject to any disclaimer, the term of this patent is extended or adjusted under 35 U.S.C. 154(b) by 0 days.

(21) Appl. No.: 18/168,253

(22) Filed: Feb. 13, 2023

Related U.S. Application Data

(63) Continuation-in-part of application No. 17/934,080, filed on Sep. 21, 2022.

(51) Int. Cl.
*A63C 17/26* (2006.01)
*A63C 17/00* (2006.01)

(52) U.S. Cl.
CPC ..... *A63C 17/262* (2013.01); *A63C 17/0006* (2013.01)

(58) Field of Classification Search
CPC ..... B63B 32/45; A63C 17/26
See application file for complete search history.

(56) References Cited

U.S. PATENT DOCUMENTS

| | | | | |
|---|---|---|---|---|
| 5,308,271 | A * | 5/1994 | Foulke | A47K 3/002 441/74 |
| 5,484,312 | A * | 1/1996 | Zepeda | B63B 32/45 441/74 |
| 6,193,276 | B1 * | 2/2001 | Sottile | A63C 17/01 280/87.042 |
| 11,267,540 | B1 * | 3/2022 | Appell | B63B 32/45 |
| 11,267,541 | B1 * | 3/2022 | Appell | B63B 32/45 |
| 2003/0124923 | A1 * | 7/2003 | Mercer | B63B 32/45 441/74 |
| 2014/0144050 | A1 * | 5/2014 | Smith, III | A43B 1/0072 36/137 |

* cited by examiner

*Primary Examiner* — Stephen P Avila

(57) ABSTRACT

A traction system comprising interchangeable hollow kick tails, mounting plates and traction pad material for mounting to the deck of a surfboard and skateboard, and a skateboard uniquely designed to have the same arched deck as a typical surfboard so that said mounting plates can be used to mount the hollow kick tails to surfboards and said skateboard. The kick tails are configured with a ramped face angled optimally for surfing. Different variations include a ramp to a flat top, a ramp to a vertical face, a ramp to an angled overhang and a ramp to a horizontal overhang. The wide ramp area design in the kick tails provides support for the entire rear foot while surfing and helps the surfer perform aggressive maneuvers without falling. The interchangeable kick tails can be removed from a surfboard and attached to a surfer's skateboard or removed from their skateboard.

14 Claims, 22 Drawing Sheets

Interchangeable Skateboard and Surfboard Ramp to Flat Top Kick Tail
Arched Mounting Plate With Tongue
Front Perspective View Interchangeable Skateboard and Surfboard Ramp to Flat Top Kick Tail
Arched Mounting Plate With Tongue
Front Perspective View Skateboard and Surfboard Traction Pad Base
With Ramp To Vertical Rise Hollow Interchangeable Skateboard and Surfboard Traction Pad Kick Tail
Two Piece Ramp To Angled Overhang
Front View Interchangeable Skateboard and Surfboard Kick Tail and Traction Pad
Ramp To Horizontal Overhang
Arched Skateboard Deck, Mounting Plate and Kick Tail Bottom
Front Perspective View Skateboard and Surfboard Interchangeable Kick Tail and Traction Pad
Ramp to Flat Top
Side View Skateboard and Surfboard Interchangeable Kick Tail and Traction Pad
Ramp to Vertical Face
Side View Hollow Skateboard and Surfboard Interchangeable Kick Tail
Two Piece Ramp To Angled Overhang
Front View Hollow Skateboard and Surfboard Traction Pad Kick Tail
Two Piece Ramp To Horizontal Overhang
Front View Interchangeable Skateboard and Surfboard Ramp to Flat Top Kick Tail
No Traction Material On Kick Tail
Arched Mounting Plate With Tongue
Front Perspective View Interchangeable Skateboard and Surfboard Traction Pad Kick Tail With Ramp to Vertical Rise With No Traction Material On Kick Tail
Front Perspective View Hollow Skateboard and Surfboard Interchangeable Kick Tail
Two Piece Ramp To Angled Overhang
Wax For Grip
Shows Mounting Bolts
Front View Skateboard Traction Pad With Horizontal Overhang
Cut Out Options
Top View Skateboard Traction Pad With Horizontal Overhang
Cut Out Options
Top View Kick Tail Mounting Plate With Tongue
With Leash Pin Cut Out
Front Perspective View
FIG. 14
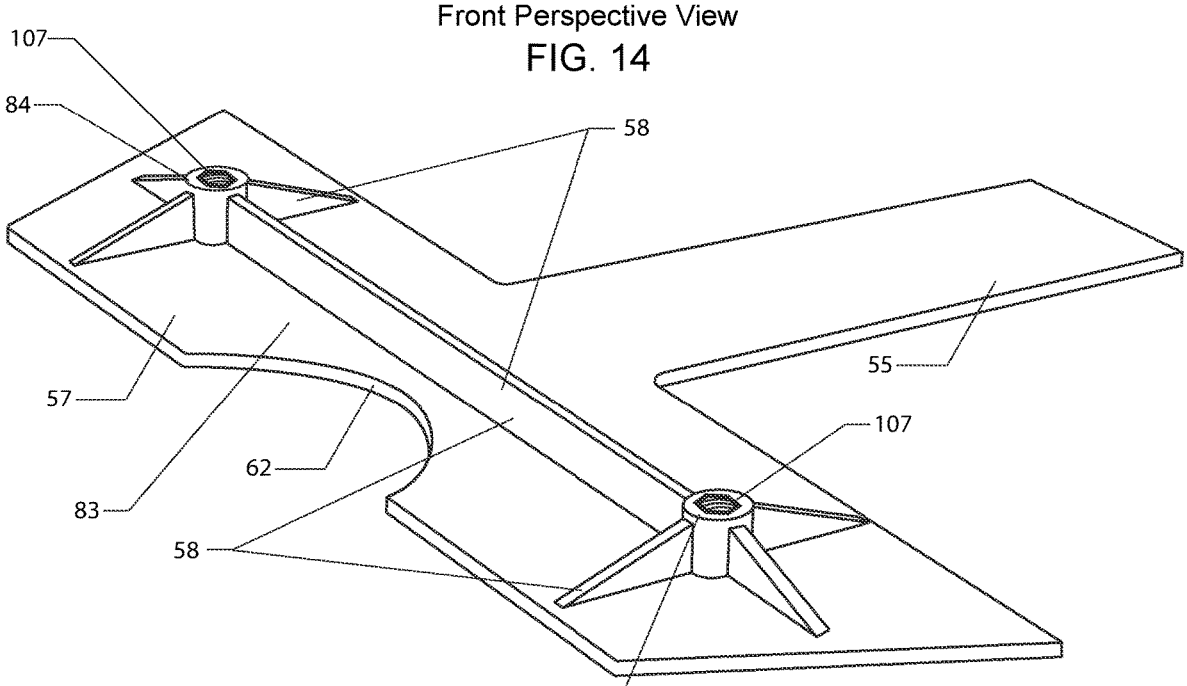
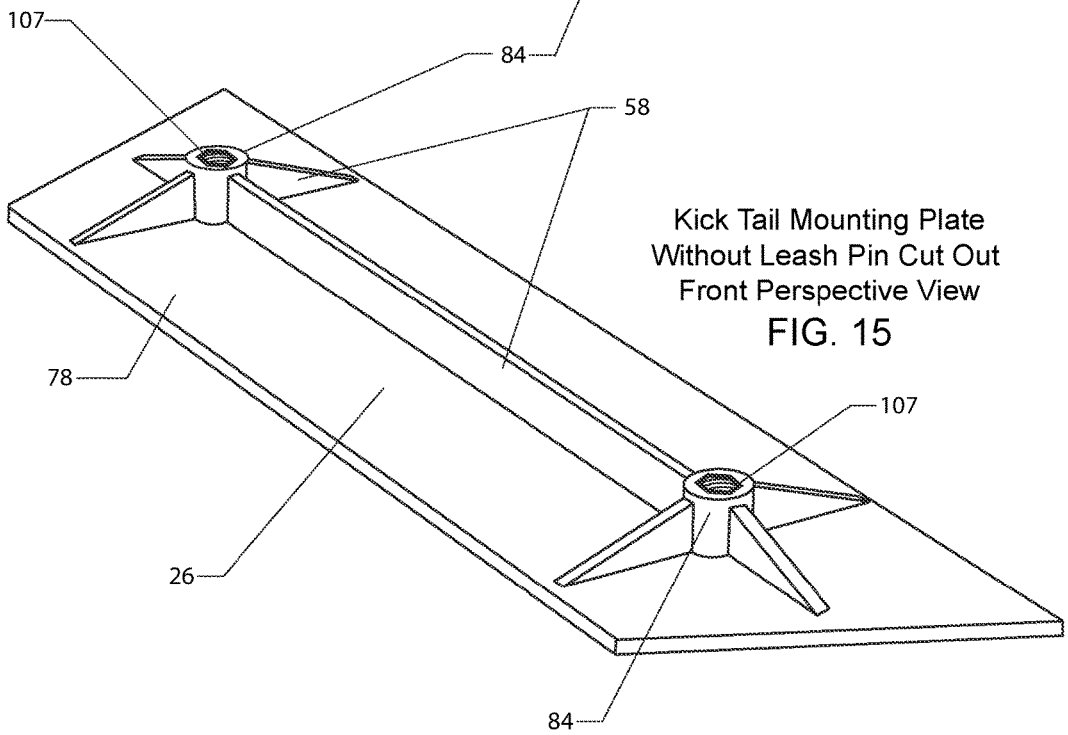
Kick Tail Mounting Plate
Without Leash Pin Cut Out
Front Perspective View
FIG. 15

Skateboard With Mounting Plate
Top and Front View

Hollow Skateboard and Surfboard Kick Tail
With Ramp To Flat Top
Bottom Perspective View Injection Molded Hollow Skateboard and Surfboard Kick Tail
With Ramp To Vertical Rise For Use With Wax
Rounded Edges, Arched Base Bottom
Top Perspective View Angled Overhang Kick Tail
Wax for Grip
Top Piece
Top and Front View Angled Overhang Kick Tail
Wax for Grip
Bottom Piece
Top and Front View Hollow Skateboard and Surfboard Kick Tail
Designed for Use With Traction Pad Material
Ramp To Flat Top
Front View Hollow Skateboard and Surfboard Kick Tail
Wax For Grip Ramp To Flat Top
Front View Hollow Skateboard and Surfboard Traction Pad Kick Tail
Two Piece Ramp To Horizontal Overhang
Designed for Grip With Wax
Front View

TRACTION PAD SYSTEM FOR SKATEBOARDS AND SURFBOARDS

BACKGROUND OF THE INVENTION

The present invention pertains to skateboards and surfboards. The upper surface of the skateboard is referred to as the deck. The two T-shaped axle assemblies used for turning are referred to as the trucks. Wheels are attached to the trucks to allow the skateboarder to glide smoothly on whatever surface the skateboarder is skating on.

Most surfers experience a significant amount of time unable to surf because weather conditions have made the surf unfavorable for surfing. For this reason many surfers use skateboards to practice surf maneuvers when the surf is unrideable. Skateboarders stand on the deck with one foot planted near the tail (rear) and the forward (front) foot planted nearer the front of the skateboard. Current skateboards used for practicing surf maneuvers have an angled area at the rear, are concave on the sides and have no traction pad or traction pad material on the deck. The deck of the skateboard is typically covered with a silicone carbide grip, very similar to sandpaper, that provides traction for the skater. But this grip surface feels nothing like the EVA foam or wax used for providing traction on a surfboard.

The problem with existing skateboards used to practice surf maneuvers is that they look and feel like skateboards. Skateboards are designed to be ridden with skateboarders wearing shoes. Surfers often do not wear shoes when surfing. They typically surf barefoot or in colder waters wearing rubber booties. There needs to be a skateboard that looks and feels exactly like a surfboard under the skateboarder's feet, that can be comfortably ridden barefoot, and equipped with the same kick tail and traction pad material that's on their surfboard so the skateboard feels exactly like the surfboard under the skateboarder's feet.

U.S. Pat. No. 11,267,541 shows the design of an enhanced surfboard traction pad system that comprises traction pad material affixed to the deck of the surfboard, interchangeable kick tails that are made in many different configurations, shapes and sizes and a mounting plate for attaching said kick tails to a specially modified surfboard. The present invention comprises new configurations of kick tails and a mounting plate that require no modification to a surfboard for mounting, and a uniquely designed skateboard that utilizes a similar mounting plate used for surfboards so that all of the kick tails are interchangeable between surfboards and said skateboard. It should be noted that bases referred to in U.S. Pat. No. 11,267,541 are referred to herein as kick tails and mounting bases are referred to herein as mounting plates.

In order for the skateboarder to have the closest experience to surfing, the skateboard deck needs to be configured exactly like their surfboard. This means the skateboard deck, ideally should be slightly arched like a surfboard deck and have a kick tail on the rear end of the skateboard that is exactly the same as the kick tail the skateboarder uses for surfing. If the skateboard feels exactly like a surfboard under the skateboarder's feet, the skateboarding experience will be the closest to surfing. This is accomplished by installing a version of the traction pad system presented in U.S. Pat. No. 11,267,541 B1 on a specially designed skateboard. Said skateboard is designed to accommodate the mounting plate specified herein which is bolted, glued, or affixed with adhesive to said skateboard with the area in front of the kick tail on the skateboard deck covered with a similar type of traction pad material used for surfboards or wax typically used by surfers to provide grip on their surfboard. Interchangeable kick tails can be screwed onto said mounting plate.

Significant differences between this patent and U.S. Pat. No. 11,267,541 are as follows: The mounting plate described herein has been updated to be arched like the deck of a surfboard and flexible so it will fit onto a typical surfboard with no modification required for the surfboard. Said mounting plate can be mounted to surfboards and said specially designed skateboard. The kick tails are all hollow so they are extremely light weight and can be manufactured, if desired, using an injection molding process, and have an arched bottom to fit flush with the updated mounting plate. The mounting plates and kick tails can be affixed to surfboards and the skateboard design presented herein. Kick tails are designed for use with EVA foam or some other traction pad material glued to the surface for grip and protection for the surfer and skateboarder's foot, and said kick tails are also designed for getting grip from surfboard wax applied where needed without the use of EVA foam or traction pad material.

One of the big reasons why surfers use traditional traction pads is so they can feel with their foot where the back of the board is. Up until now the only way for them to do that is by using an EVA foam traction pad with a small kick tail at the back, but EVA foam kick tails are not as wide as a surfer's foot so their functionality is limited, and EVA foam doesn't grip as well as wax. With one of the options of the present invention, an interchangeable kick tail can be mounted to the surfboard and with wax applied to the kick tail and the surfboard, the option of having no EVA foam on the surfboard is available with all grip provided by surfboard wax.

When manufactured out of nylon or some other plastic, the kick tails presented herein will be very durable, long-lasting and provide a ramp angled perfectly for surfing that supports the surfer's entire foot. Traditional traction pads only provide traction and require surfers to surf with their rear foot flat on their surfboard so it's easy to fall. The flat top, vertical rise, angled overhang and horizontal overhang kick tails presented herein will help anyone surf better because of the aforementioned ramp and pocket area for the foot to reside created with the vertical rise, angled overhang and horizontal overhang kick tails, and the horizontal overhang kick tail can be used to help surfers learn to how to execute aerial maneuvers by lifting the surfboard out of the water with their back foot.

SUMMARY OF THE PRESENT INVENTION

A traction system comprising a specially designed skateboard 7, 87 of any length and width shaped with an arched deck typical of the arch found in a surfboard and designed to provide a flush fit for a mounting plate with a similarly arched bottom that is affixed to said skateboard with either bolts and nuts or glue or other adhesive and interchangeable kick tails that slide onto the top of said mounting plate that are secured with screws. The kick tails are comprised of two groups: those using EVA foam or some other rubber-like substance with good grip characteristics glued to the kick tail for traction, and those designed for getting grip from surfboard wax applied where needed without the need for EVA foam or rubber to provide traction.

Kick tails with EVA foam or rubber include a ramp going into a flat top 77, a ramp going into a vertical rise 30, a ramp going into an angled overhang 98, and a ramp going into a horizontal overhang 97 with traction pad material affixed to said kick tails for grip with glue or other adhesive. Kick tails designed for getting grip with surfboard wax include a ramp going into a flat top 50, a ramp going into a vertical rise 51, a ramp going into an angled overhang 99, and a ramp going into a horizontal overhang 53, with said traction pad material extending forward from the front of the kick tail ramp towards the nose of the skateboard 7, 87 and surfboard 8 and affixed to the skateboard 7, 87 and surfboard 8 with adhesive, with enough space between the kick tail and the rear end of the traction pad so the interchangeable kick tails can be easily removed. The purpose of the specially designed skateboard 7, 87 is to practice surfing maneuvers on land with the closest feeling possible to surfing.

The skateboard deck 7 shall be designed to be arched to provide a flush mount for the traction pad mounting plate 83, 65 which is affixed to said skateboard deck using glue, adhesive material or bolts 25 going through said traction pad mounting plate and skateboard deck that are secured with nuts on the underside of said deck. Said mounting plates 26, 57, 83 are used for attaching removable and interchangeable kick tails 77, 30, 98, 97, 50, 51, 99, 53 to skateboards and surfboards. Mounting plates have an arched bottom shaped to match the arch in the deck of a typical surfboard and are made of material that is rigid but flexible enough to easily bend to the shape of the surfboard deck and flush mounted with adhesive to the surfboard so that no modification to the shape of the surfboard is necessary for the mounting plate to achieve a secure and flush fit to the surfboard deck. Said mounting plates 26, 57, 83 are also used for affixing said kick tails to skateboards. When mounted to a surfboard, the mounting plate may be affixed with adhesive or glue. When mounted to a skateboard, the mounting plate may be affixed with adhesive, glue or bolts 25 and nuts. Mounting plates are made from nylon, plastic or metal.

Nylon or plastic threads would strip over time so mounting plates 26, 83 made from these materials are configured with female metal threaded inserts 107 affixed inside barrels 84 which extend up from said mounting plates 26, 83 into which screws 39 are inserted to secure kick tails to said mounting plate. For skateboards with a metal mounting plate the female threading into which the screws are affixed is optionally molded or machined into the metal mounting plate. A kick tail which is used for surfing may be removed from the surfboard by unscrewing the screws 39 that are screwed into the threaded metal inserts 107, and inserted into a mounting plate 26, 57, 83 affixed to a skateboard. Or a kick tail that is used for skateboarding may be removed from the skateboard by unscrewing the screws 39 that are screwed into the skateboard mounting plate and inserted into a mounting plate 26, 83 affixed to a surfboard.

EVA rubber foam or some other suitable material with a surface manufactured for making the traction pad easy to grip with the surfer and skateboarder's foot without slipping, hereinafter called traction pad material, is to be permanently affixed using glue or any suitable permanent adhesive to the front and top of the kick tails 77, 30, 98, 97 and top pieces 66, 54 that will come into contact with the skateboarder or surfer's foot. A different piece of traction pad material 3 will extend from the front of the base 74 so the kick tail can be easily removed, and the traction pad material 80, 81 will extend forward towards the front of the skateboard and surfboard, affixed to the skateboard and surfboard with adhesive, as far as is needed to provide optimum traction for the skateboarder and surfer's front and rear foot while skateboarding or surfing.

The kick tail mounting plate will be affixed at the tail end of the skateboard 7 slightly behind the rear trucks 31. 85 shows a representation of the preferred embodiment. The kick tail with ramp going into an angled 98, 99 or horizontal 97, 53 overhang allows the skateboarder and surfer to lift the tail of the skateboard and surfboard by pressing against the underside of the kick tail overhang with the top of the back foot. The kick tail can have a curved 41, 42 or angled 40, 43 cut out for the skateboarder and surfer's ankle of optimum configuration to allow freedom of movement while skateboarding and surfing.

All kick tails are affixed to skateboards and surfboards using mounting plate 26, 83. Said mounting plates are arched to the same degree of curvature as a typical surfboard deck. When installed on a skateboard or surfboard, if said mounting plate is affixed to the skateboard or surfboard using adhesive or glue, said mounting plate is configured with an optional tongue 55 that extends forward to provide more surface area for said adhesive to secure the mounting plate to the skateboard and surfboard deck. If traction pad material is used instead of wax for grip, said tongue is placed under the traction pad material extending forward on the skateboard and surfboard from the ramp area of the kick tail.

This traction pad system provides the advantage of a skateboard that is practically identical to the rear end of a surfboard equipped with a mounting plate and kick tail as specified herein, allowing the skateboarder's foot to be planted in the same position as when surfing for optimum practicing of surf maneuvers on said skateboard. It has the advantage of having a ramp 4 angled perfectly for surfing and the advantage of having an optional overhang for lifting the tail end of the skateboard off of the ground 97, 98, 99, 53 for aid in practicing aerial maneuvers, provides maximum push and lifting options for the skateboarder at the tail end of the skateboard by utilizing only the back foot, keeps the front foot free to move to wherever is best for any maneuver, and allows the back foot to be easily removed from the overhang area when falling or getting off of the skateboard.

The kick tails 77, 30, 38, 1, 50, 51, 52, 53 are made of material of sufficient density and rigidity to withstand pressure from the skateboarder's foot without breaking, preferably nylon or plastic. All kick tails are hollow, have supporting ridges 88 to provide strength, and are designed optimally for manufacturing using an injection molding manufacturing process or any other manufacturing process that will result in the intended design. Traction pad material 3 would be permanently affixed to kick tails 77, 30, 38, 1 in the front ramp area with adhesive.

The flat top and vertical rise kick tails 77, 30, 50, 51 are designed to be a single piece of injection molded material, and the angled and horizontal overhang kick tails 97, 98, 99, 53, are designed to have bottom 38, 52 and top pieces 66, 102 glued together.

When affixing a mounting plate 26, 83 to a surfboard, adhesive will be affixed to the underside of the mounting plate and ideally, because the adhesive layer has tackifying characteristics which result in it's adhesion to the surfboard deck upon contact, it's preferable that layer of coating be protected, prior to use, from adhesion to an undesired surface by some protective means. In the preferred embodiment the protective means is comprised of a paper with it's waxed surface in contact with the coating area and being waxed so as to provide ease of removal of the paper, such as peeling off action. Upon removal of the protective paper the adhesive is fully exposed and ready for adhesion to the desired surface.

In order to affix the mounting plate 26, 83 to the deck of the surfboard, 8 in adequate fashion so it does not dislocate from the deck upon use, the surface of the deck must be suitably prepared. It's necessary to remove any interfering fluids and substances, such as dirt, oil and wax, which are on the portion of the deck where the mounting plate is to be mounted. Removal can be accomplished by a number of ways known in the art, such as cleaning, scraping or by applying a suitable solvent such as acetone. Preferably the surfboard would be initially designed with a clean deck surface so little or no cleaning would be required. Sanding the area under where the mounting plate will be installed is recommended to provide a rough surface for the adhesive to bond to.

Upon this preparation the mounting plate is ready to be mounted to the surfboard. The protective paper is removed, and the bottom of the mounting plate 26, 83 is positioned slightly above the location where the mounting is to occur. The protective layer is removed exposing the adhesive layer for contact with the skateboard deck. The mounting plate is lowered to come into contact with the surfboard deck. Pressure is then applied in sufficient amount to secure the bonding of the adhesive to the surfboard. In order to adequately assure the completeness of the bonding, it's recommended that before use a sufficient waiting period be undertaken while pressing the adhesive to the deck, ideally overnight with clamps pressing the mounting plate to the surfboard deck. Once the adhesive has had time to cure and the mounting plate and traction pad material is securely attached with adhesive, the mounting plate is ready for use.

In order to affix the mounting plate 26, 83 to the deck of the skateboard 87 adhesive may be used in the same manner as with affixing the mounting plate to the surfboard deck. Said mounting plate can also be affixed to the skateboard deck with glue, bolts 25 and nuts or a combination of adhesive and bolts 25 and nuts. Traction pad material 3 is affixed to the surfboard 9 and skateboard 7 deck with adhesive in the same manner outlined for affixing the mounting plate to the surfboard deck.

Mounting plates have an arched bottom to fit flush with the arched skateboard deck, and kick tails have an arched bottom to fit flush with said mounting plates. Said mounting plate has barrels 84 that protrude up from said plate having threaded metal inserts 107 that are aligned with mounting holes 15 in the enhanced skateboard kick tails 77, 30, 98, 97, 50, 51, 99, 53 through which mounting screws 39 are screwed into to secure kick tails to said mounting plate. Said kick tails are detachable and interchangeable with each other with the advantage of being able to quickly change configurations to suit the surfer or skateboarder's needs.

The screws 39 used to mount kick tails to the mounting plate, preferably would be made of any material that would not be adversely affected by exposure to salt water, such as 316 stainless steel. The location of mounting holes 15 and barrels 84 may be placed wherever is most convenient to achieve a firm and secure connection of the mounting plate to said kick tails. Two mounting holes and barrels are shown in the present embodiment but any number of mounting holes and barrels needed for a secure connection can be used. All barrels have threaded female metal inserts 107 if the mounting plate material is nylon or plastic.

Traction pad material affixed to the deck of the surfboard or skateboard can be one piece 3 or can be configured with multiple pieces 80, 81 abutting together. Since all kick tails are interchangeable, the traction pad material on the kick tails is separate from the traction pad material affixed to the surfboard and skateboard deck.

It should be noted that because of the flexible design, location of the mounting plate 26, 83, when mounting to a surfboard or a skateboard the mounting plate can be mounted back far enough for the user's rear foot to be securely planted at the optimum spot for executing sharp turns, but it can be mounted as far forward as is desired.

There is a cut-out area 40, 41, 42, 43 for the surfer and skateboarder's ankle to be able to have more range of motion without being constrained by the overhang 29 at the front of the enhanced skateboard traction pad. Said cut out can be of any length or shape, curved or angular.

Skateboarders and surfers enjoy being stylish by riding bright colored skateboards and surfboards of many colors. For this reason, all kick tails and mounting plates can be of any color or combination of colors, and also be manufactured in different sizes to accommodate feet of different sizes. All kick tails are designed to be colored or clear and have a pocket for holding waterproof LED lights 75 to illuminate said kick tails so skateboarders and surfers surfing at night can enjoy a lighted kick tail experience.

The enhanced skateboard and surfboard kick tails have horizontal and vertical surfaces 12 upon which a product name, branding and/or advertising message can be displayed. Said product name, branding and/or advertising message is printed or molded into the kick tails and traction pad material 3 and/or stamped on with permanent ink, or a silicone heat transfer logo or message may be affixed with adhesive. Said message may be any number of words in any language with or without an accompanying logo or graphic design.

To summarize, by using the traction system presented herein, surfers will enjoy being able to perform more aggressive maneuvers without falling as much because their rear foot is firmly planted on the ramp area of all kick tails which is angled perfectly for surfing. They will be able to lock their rear foot into the pocket created by the vertical rise, angled overhang, and horizontal overhang kick tails and perform tricks impossible to accomplish without said kick tails. They will be able to enjoy having a kick tail that is coated with surfboard wax for grip if they so desire, or they can optionally enjoy using the same kick tail with traction pad material affixed to provide grip, and they can practice all of their maneuvers on a skateboard equipped with the same kick tails.

These embodiments are not limited to the specific embodiments mentioned above and other forms of the invention are within it's spirit and scope as set forth in the claims hereafter.

BRIEF DESCRIPTION OF THE DRAWINGS

FIG. 14 is a perspective view of a mounting plate 83 with metal inserts 107, a leash pin cut out 62 and a tongue 55.

FIG. 15 is a perspective view of a mounting plate 78 with metal inserts 107 without a leash pin cut out or tongue 55.

DETAILED DESCRIPTION

Figure 1:
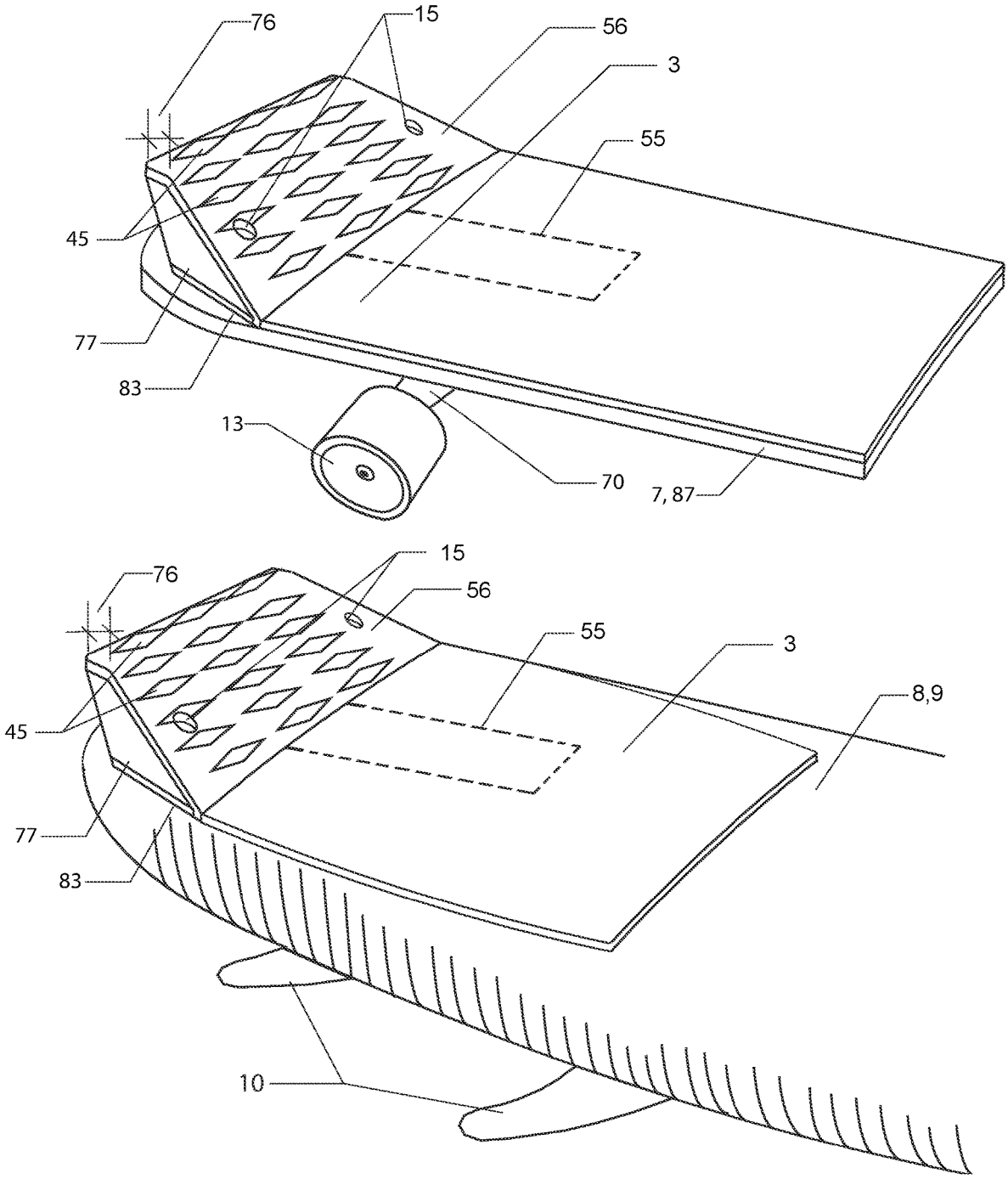
FIG. 1 is a perspective view of a 7 skateboard and surfboard 8 equipped with a kick tail 77 comprising a ramp 4 going into a flat top, with traction pad material and mounting plate 83 with tongue.

Various terms used herein are intended to have particular meanings. Some of these terms are defined herein for the purpose of clarity. The definitions given below are meant to cover all forms of the words being defined (e.g. singular, plural, present tense, past tense). If the definition below diverges from the commonly understood and/or dictionary definition of such term, the definitions below control.

Embodiments described herein include a skateboard and surfboard traction system comprising traction pad material affixed to the deck of a uniquely designed skateboard 7 and detachable and interchangeable kick tails with and without traction pad material 3 affixed for attachment to the tail end of a skateboard 32 and surfboard 9 deck. Using said system surfers can practice surf maneuvers on their skateboard and feel exactly what they feel under their feet when surfing while skateboarding. The interchangeable kick tails can be removed from a surfboard 8 and mounted on a skateboard 7 or removed from a skateboard 7 and mounted on to a surfboard 8 by affixing said kick tails to mounting plates 26, 83 designed to fit said kick tails. Kick tail options 38, 97, 98, 52, 53, provide a pocket 68 for the skateboarder and surfer's foot so the skateboarder and surfer may push back or lift up the tail end of the skateboard and surfboard with the rear foot while maintaining a secure rear foot point of contact with the skateboard and surfboard. The traction pad material 3 has a surface that is easy to grip with the skateboarder's rear foot and is permanently affixed to the front side of the kick tail 77, 30, 98, 97, 50, 51, 99, 53 and extends forward onto the skateboard deck 32 for the skateboarder and surfer to stand on. For kick tails 50, 51, 52, 53 grip is achieved by applying typical surfboard wax on the top surface of the ramp 4, 73, vertical rise 18, 49, and foot pocket 68 area.

The kick tails are made with and without an ankle cut out 40, 41, 42, 43 to allow greater freedom of movement. All kick tails are arched to match the arch in the mounting plate 83. Kick tails are secured to the mounting plate with screws 39 screwing into metal inserts 107 permanently affixed inside mounting plate barrels through holes 15. In the case where the mounting plate is cast as one piece of metal, barrels 84 are threaded into which screws 39 secure kick tails to said mounting plate. Traction pad material and kick tails can be of any color or combination of colors. Kick tails are also designed to be clear with LED lights placed inside said kick tail in a specially designed area for lighting 75. LED lights are secured in place when the kick tail is inserted onto the mounting plate and screwed in place. Kick tails are designed for skateboarding and surfing with the left or right foot placed on the kick tail.

Referring to FIG. 1, a perspective front view of a skateboard 87 and surfboard 8 is shown equipped with a traction pad with a kick tail 77 comprising a ramp 4 going into a flat top. The deck 7 of the skateboard 87 has been suitably modified by creating an arched deck 87 matching the arch in the surfboard 8. A mounting plate 83 with a tongue 55 extending under the traction pad material affixed to the skateboard and surfboard deck is affixed to the skateboard and surfboard deck with adhesive. The same kick tail 77 and mounting plate 83 is used for the skateboard and surfboard. Said kick tail is shown with traction pad material 56 molded to exactly fit the top of said kick tail featuring an optional raised diamond shaped rhombus for traction. The optional raised traction area can be any shape or thickness. The kick tail 77 has an arched bottom that fits flush onto the mounting plate 83. The mounting plate 83 is affixed with adhesive to the skateboard 7 and surfboard deck 9. The kick tail is affixed to the mounting plate in both skateboard and surfboard by screws 39 going through mounting holes 15 which screw into female threaded metal inserts 107 inside barrels 84 protruding up from mounting plate 83. The kick tail 77 is detachable by unscrewing screws 39 and is interchangeable with any other kick tail 30, 38, 50, 51, 52, 53, 54. It should be noted that wherever skateboard 87 is noted herein it is understood that the skateboard deck 87, mounting plate 83 and kick tail bottoms 77, 30, 38, 1, 50, 51, 52, 53 are all arched to match the arch in a typical surfboard deck. Traction pad material 3 extends forward from the front of the kick tail affixed to the skateboard and surfboard deck with adhesive.

Figure 2:
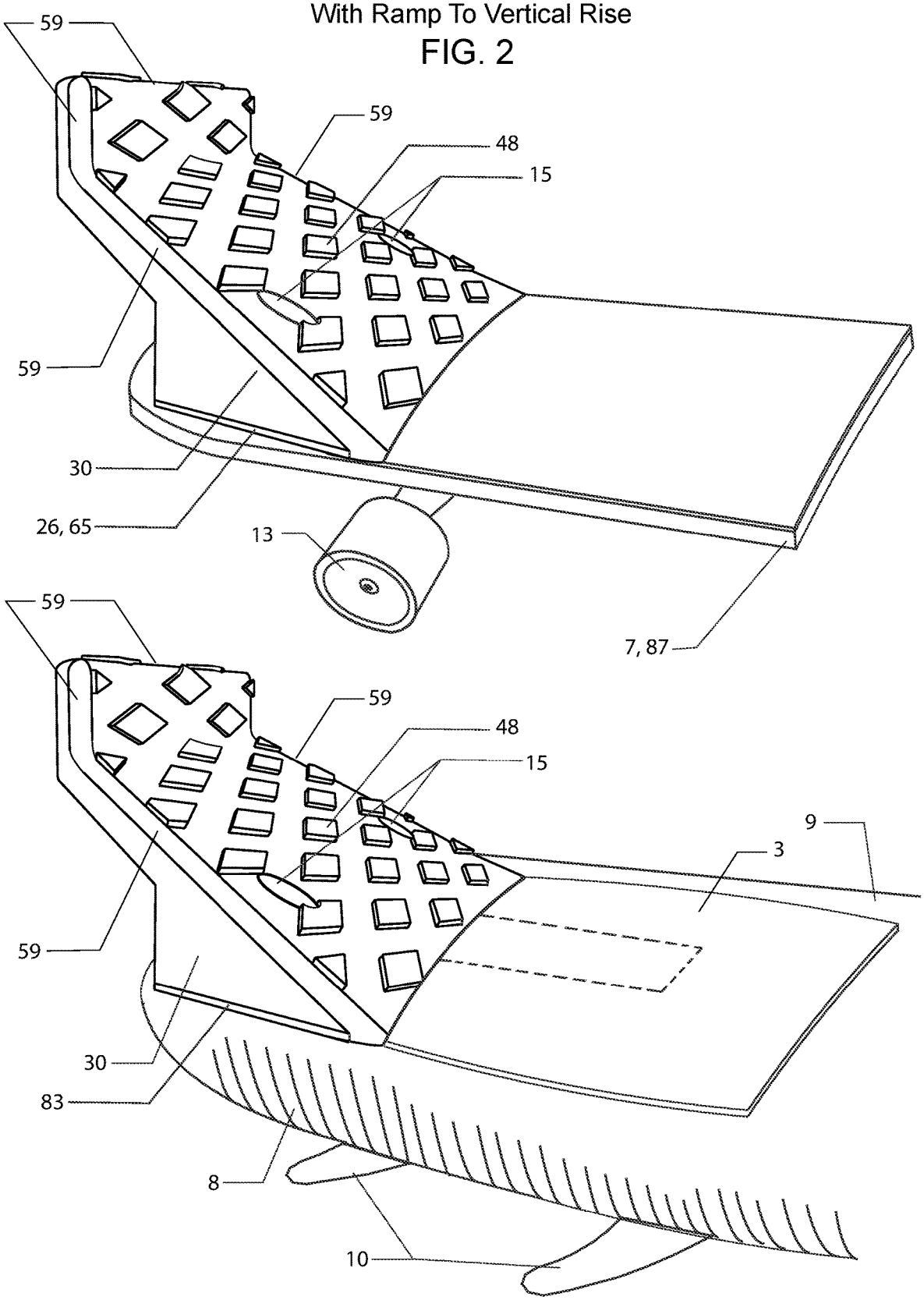
FIG. 2 is a perspective view of a 7 skateboard and surfboard 8 equipped with a kick tail 30 comprising a ramp 4 going into a vertical rise at the back. Skateboard uses a mounting plate without a tongue 26, 65 which is bolted to the skateboard deck. Surfboard uses a mounting plate 83 with a tongue affixed with glue or adhesive.

Referring to FIG. 2, a perspective front view of a skateboard 7 and surfboard is shown equipped with a kick tail 30 comprising a ramp 4 going into a vertical rise. The deck 7 of the skateboard 87 has an arched deck 87 matching the arch in the surfboard 8. A mounting plate 83 with a tongue 55 extending under the traction pad material affixed to the surfboard deck is affixed to the surfboard deck with adhesive. A mounting plate 26, 65 is bolted to the skateboard deck. The same kick tail 30 is used for the skateboard and surfboard. The kick tail is shown with traction pad material 48 molded to exactly fit the top of the kick tail featuring various shapes of raised areas for traction. The optional raised traction area can be any shape or thickness. The kick tail 30 has an arched bottom that fits flush onto the skateboard mounting plate 26, 65. The mounting plate 26, 65 is affixed with bolts 25 and nuts to the skateboard and by adhesive to the surfboard deck 9. The kick tail is affixed to the mounting plate in both skateboard and surfboard by screws 39 going through mounting holes 15 which screw into female threaded metal inserts 107 inside barrels 84 protruding up from mounting plate 83, 26. The kick tail 30 is detachable by unscrewing screws 39 and interchangeable with any other kick tail 77, 38, 54, 50, 51, 52.

Figure 3:
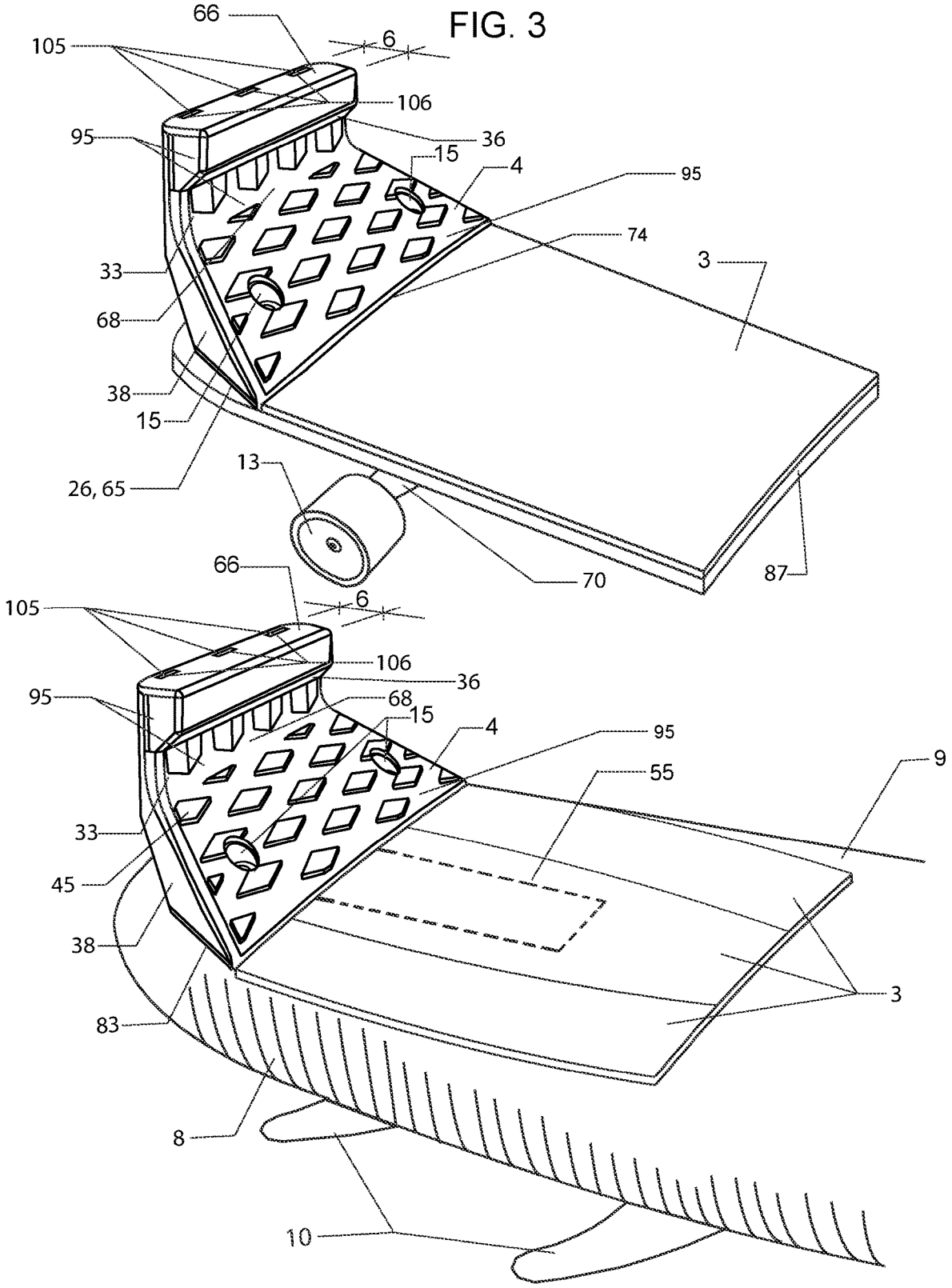
FIG. 3 is a perspective view of a 7 skateboard and surfboard equipped with a two piece kick tail 38, 66 comprising a ramp 4 going into an angled overhang. Skateboard uses a mounting plate without a tongue 26, 65 which is bolted to the skateboard deck. Surfboard uses a mounting plate 83 with a tongue affixed with glue or adhesive.

Referring to FIG. 3, a perspective front view of a skateboard 7 and surfboard 8 is shown equipped with a two piece 38, 66 kick tail comprising a ramp 4 going into an angled overhang. A mounting plate 83 with a tongue extending under the traction pad material affixed to the surfboard deck is affixed to the surfboard deck 9 with adhesive. The same two piece 38, 66 kick tail is used for the skateboard and surfboard. The kick tail bottom piece 38 is configured to have traction pad material 95 molded to exactly fit on the face of the kick tail. Various shapes of raised traction 45 areas are shown. Optional raised traction areas can be any shape or thickness. The kick tail 38 has an arched bottom that fits flush onto the skateboard mounting plate 26, 65. The mounting plate 26. 65 is affixed with bolts and nuts or adhesive to the skateboard and by adhesive to the surfboard deck 9. The kick tail bottom piece 38 is affixed to the mounting plate in both skateboard and surfboard by screws 39 going through mounting holes 15 which screw into female threaded inserts 107 inside barrels 84 protruding up from mounting plates 26, 83. The two piece kick tail 38, 66 is detachable by unscrewing screws 39 and interchangeable with any other kick tail 30, 77, 97, 50, 51, 52, 53. Foot pocket area 68 is shown.

Figure 4:
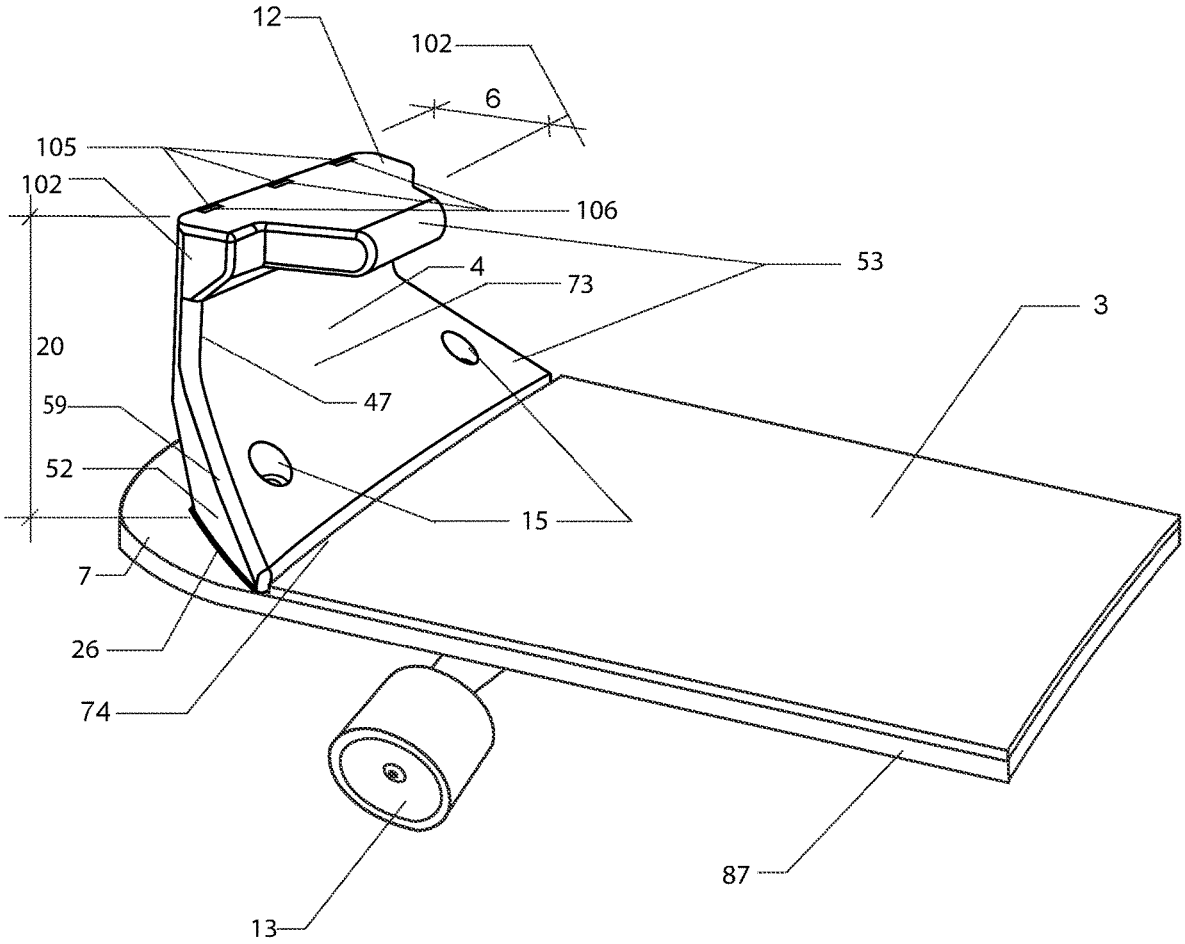
FIG. 4 is a perspective view of a 7 skateboard equipped with a two piece 38, 54 kick tail with a ramp going into a horizontal overhang 4 designed for use with wax for grip.

Referring to FIG. 4, a perspective front view of a skateboard 7 is shown equipped with a two piece kick tail 38, 54 with a bottom piece 52 affixed to the mounting plate 26 and a top piece 102 with a horizontal overhang that is glued to the bottom piece. Surfboard wax is applied to the front surface of the bottom piece for grip 73. Mounting plate 26 is affixed with adhesive or bolts 25 to the skateboard deck, the kick tail is affixed by screws 39 going through mounting holes 15 which screw into female threaded inserts 107 inside barrels 84 protruding up from mounting plate 83. Kick tail 38 is detachable by unscrewing screws 39 and interchangeable with any other kick tail 30, 77, 98, 50, 51, 97, 99.

Figure 5:
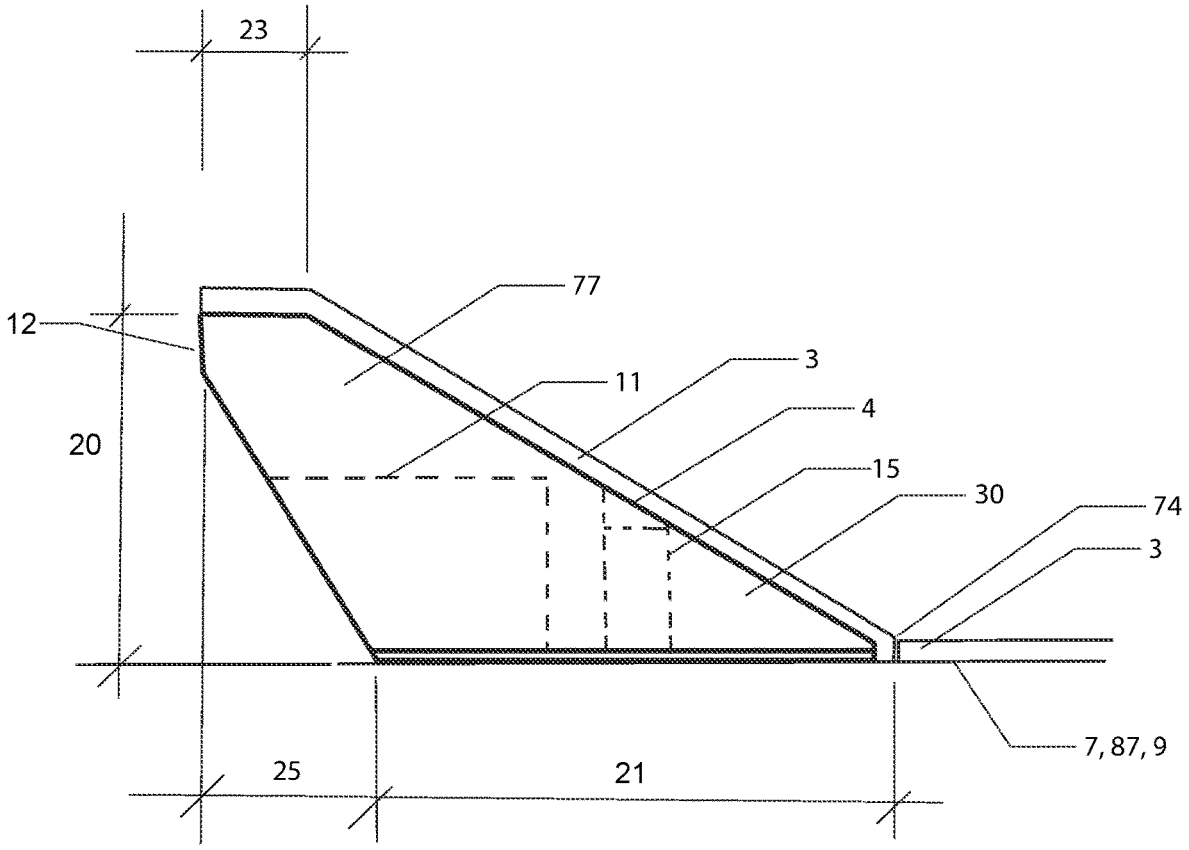
FIG. 5 is a side view of a skateboard 7 or surfboard 9 equipped with a flat top kick tail 77.

Referring to FIG. 5, a side view of a skateboard or surfboard 7 is shown equipped with a kick tail 77 comprising a ramp 4 going into a flat top. The flat top can extend forward to any height 20 and the ramp 4 can be at any angle so in production models many options can be offered to give consumers a great deal of control over how the skateboard and surfboard traction pad system is configured.

Figure 6:
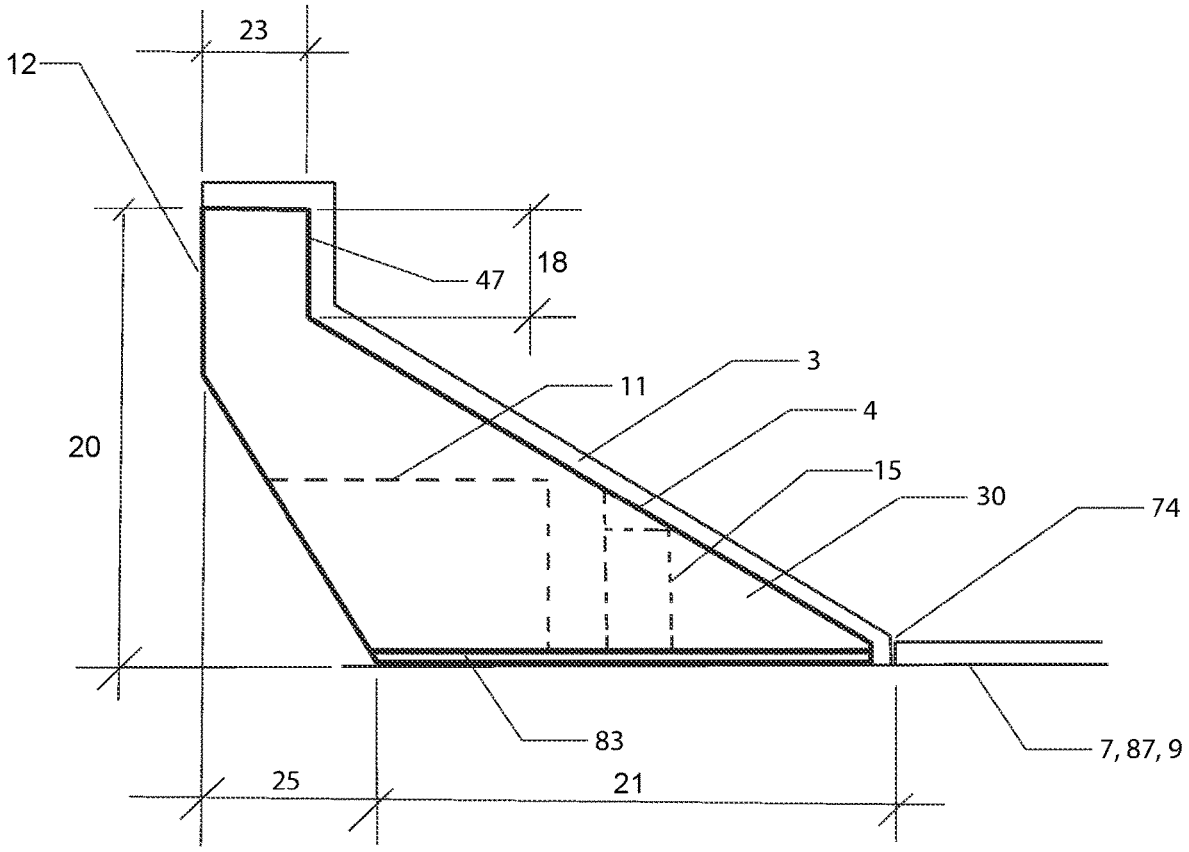
FIG. 6 is a side view of a skateboard 7 or surfboard 9 equipped with a kick tail 30 comprising a ramp 4 going into a vertical rise at the back.

Referring to FIG. 6, a side view of a kick tail 30 comprising a ramp 4 going into a vertical rise is shown affixed to a skateboard or surfboard. The vertical rise can extend up to any height and the ramp can be at any angle so in production models many options can be offered to give consumers a great deal of control over how the enhanced skateboard traction pad is configured. Traction pad material 3 is separated 74 at the foot of the ramp 4 so the kick tail 30 can be easily removed and any other kick tail 97, 77, 98, 50, 51, 97, 99 can be mounted on the mounting plate 83.

Figure 7:
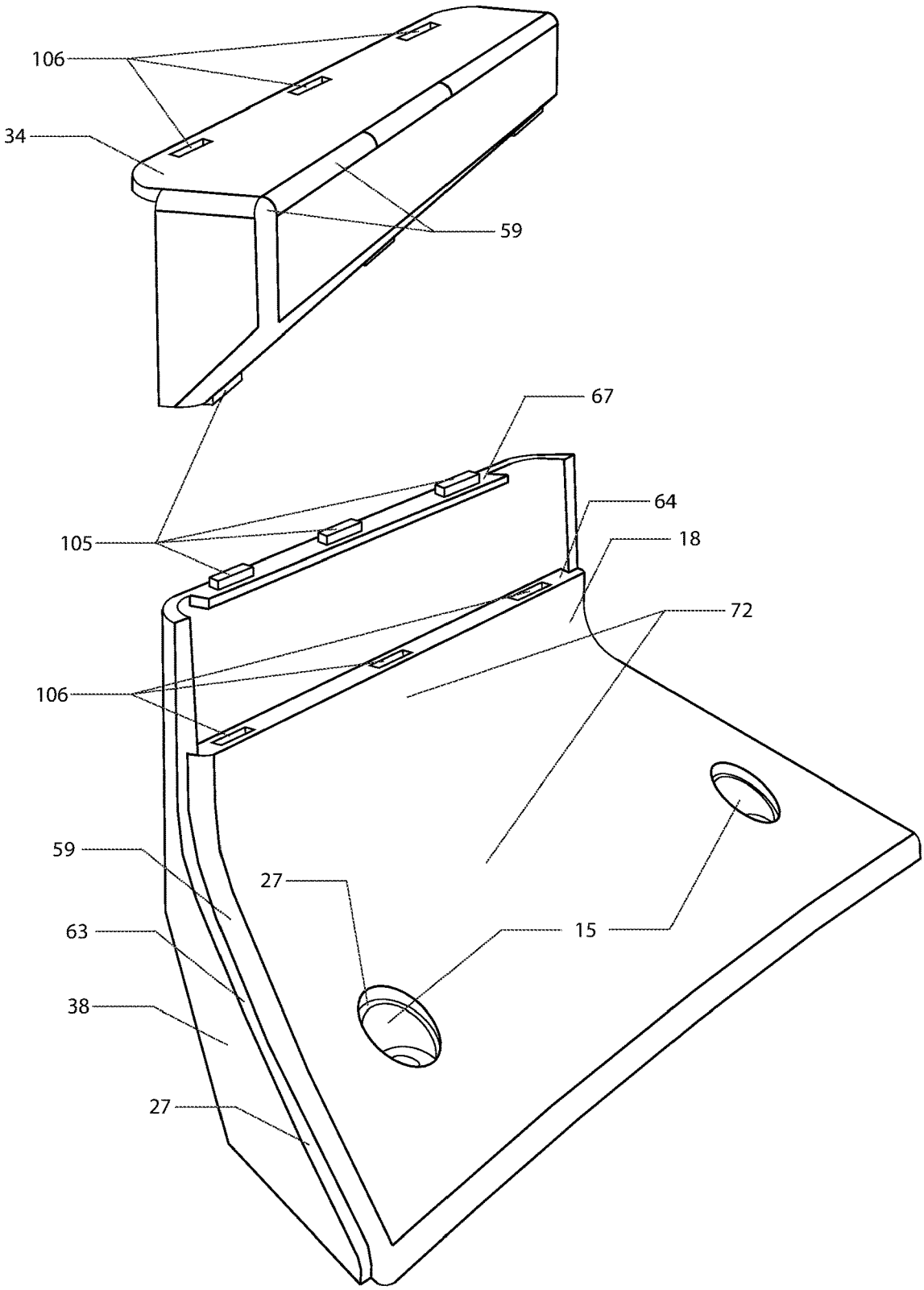
FIG. 7 is a perspective view of two piece kick tail 34, 38 comprising a bottom piece 38 designed to be glued to an angled overhang top piece 34.

Referring to FIG. 7, a perspective view of a hollow, two piece kick tail 98 with ramp going into an angled overhang is shown. The top piece 34 is designed to be glued to the bottom piece 38. The vertical rise 18 can extend up to any height, the angled overhang can be any configuration, and the ramp can be at any angle so in production models many options can be offered. The bottom piece 38 is designed to have molded traction pad material glued to the top of said bottom piece, coming over the sides and ending at the face of the recessed area 63 as shown for a flush fit. The recessed area 27, 63 where the traction pad material will be joined to the kick tail bottom piece 38 is shown. Support lip 64 for gluing top piece 34 to bottom piece 38 is shown. Pegs 105 and slots 106 are shown for interlocking top piece 34 to bottom piece 38 for a structurally secure fit when glued together.

Figure 8:
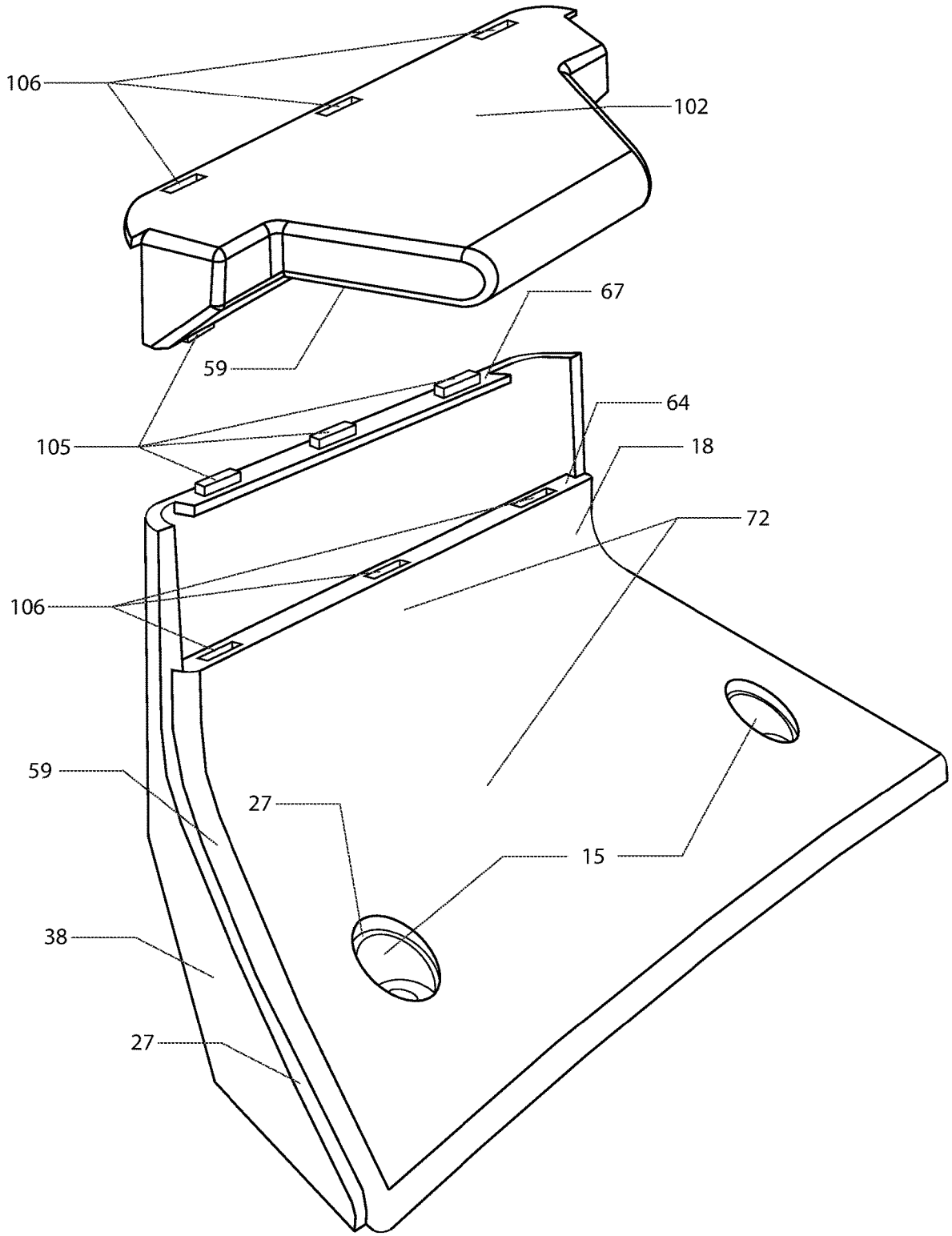
FIG. 8 is a perspective view of two piece kick tail 38, 54 comprising a bottom piece 38 designed to be glued to a horizontal overhang top piece 54.

Referring to FIG. 8, a perspective view of a hollow, two piece 38, 54 kick tail with ramp going into a horizontal overhang is shown. The top piece 102 is designed to be glued to the bottom piece 38. The vertical rise 18 can extend up to any height, the angled overhang can be any configuration, and the ramp can be at any angle so in production models many options can be offered to give consumers a great deal of control over how the kick tail is configured. The bottom piece 38 is designed to have molded traction pad material glued to the top of said bottom piece, coming over the sides and ending at the face of the recessed area 63 as shown for a flush fit. In this view no traction pad material is shown so the recessed area 27 where the traction pad material will be joined to the kick tail bottom piece 38 can be shown. Support lip 67 for gluing top piece 102 to bottom piece 38 is shown. Pegs 105 and slots 106 are shown for interlocking top piece 102 to bottom piece 38 for a structurally secure fit when glued together.

Figure 9:
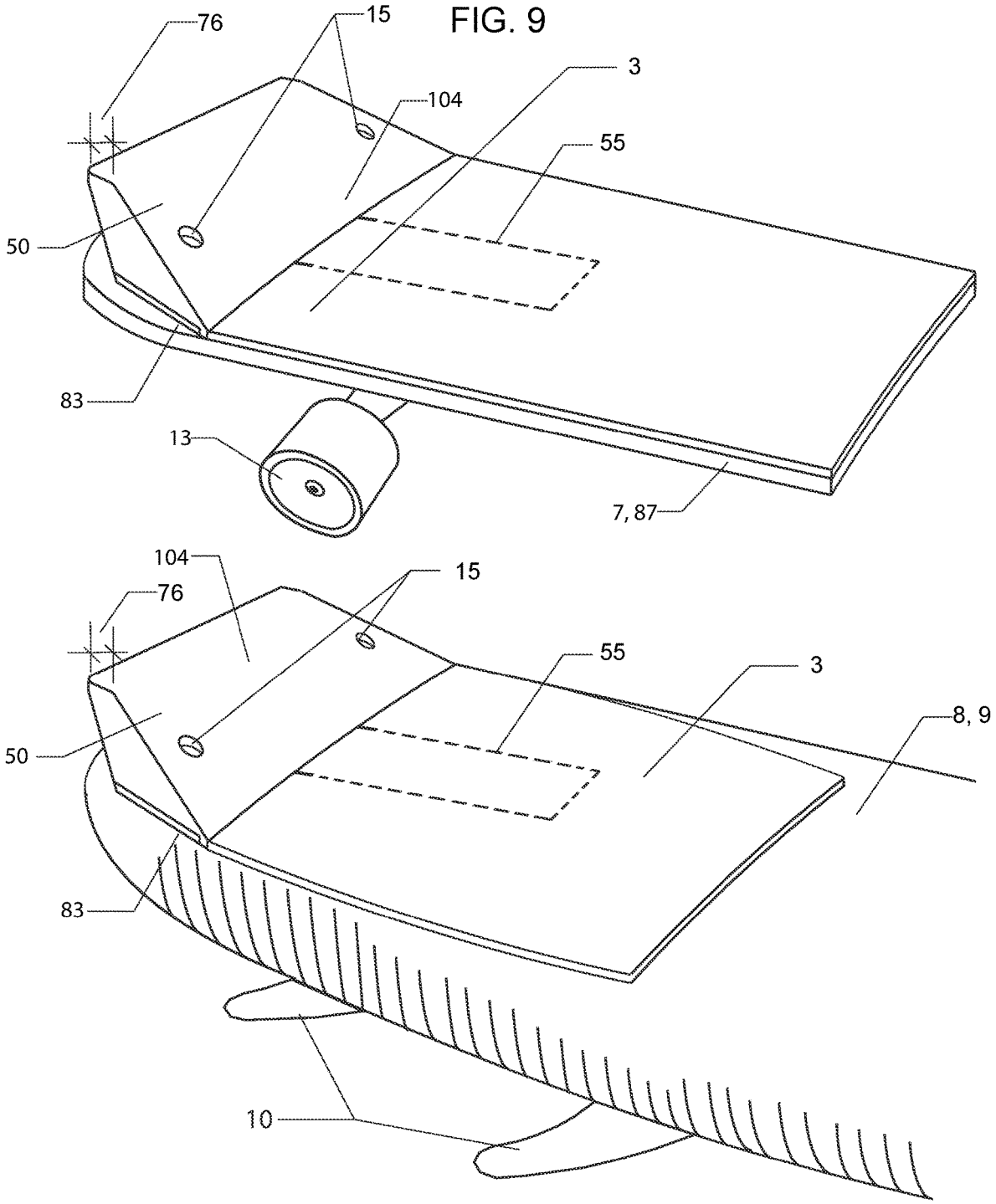
FIG. 9 is a perspective rear view of a 7 skateboard and surfboard equipped with a flat top kick tail 50 designed for providing grip with wax.

Referring to FIG. 9, front perspective views of a skateboard 7, 87 and surfboard 8, 9 are shown with a kick tail 50 featuring a flat top. Grip is provided for the kick tail 50 with surfboard wax applied to the surface of the kick tail 50, 104. The mounting plate 83 has a tongue 55 for use in securing said mounting plate 83 to the skateboard 7 and surfboard deck 9. Grip for the skateboard and surfboard deck area 7, 9 is provided with traction pad material affixed with adhesive. Traction pad material is shown affixed on top of the tongue in said mounting plate 83 to further secure said mounting plate 83 to the skateboard 7 and surfboard 9 deck. Said mounting plate 83 is secured to the surfboard deck with adhesive and secured to the skateboard deck with adhesive, glue or nuts and bolts 25.

Figure 10:
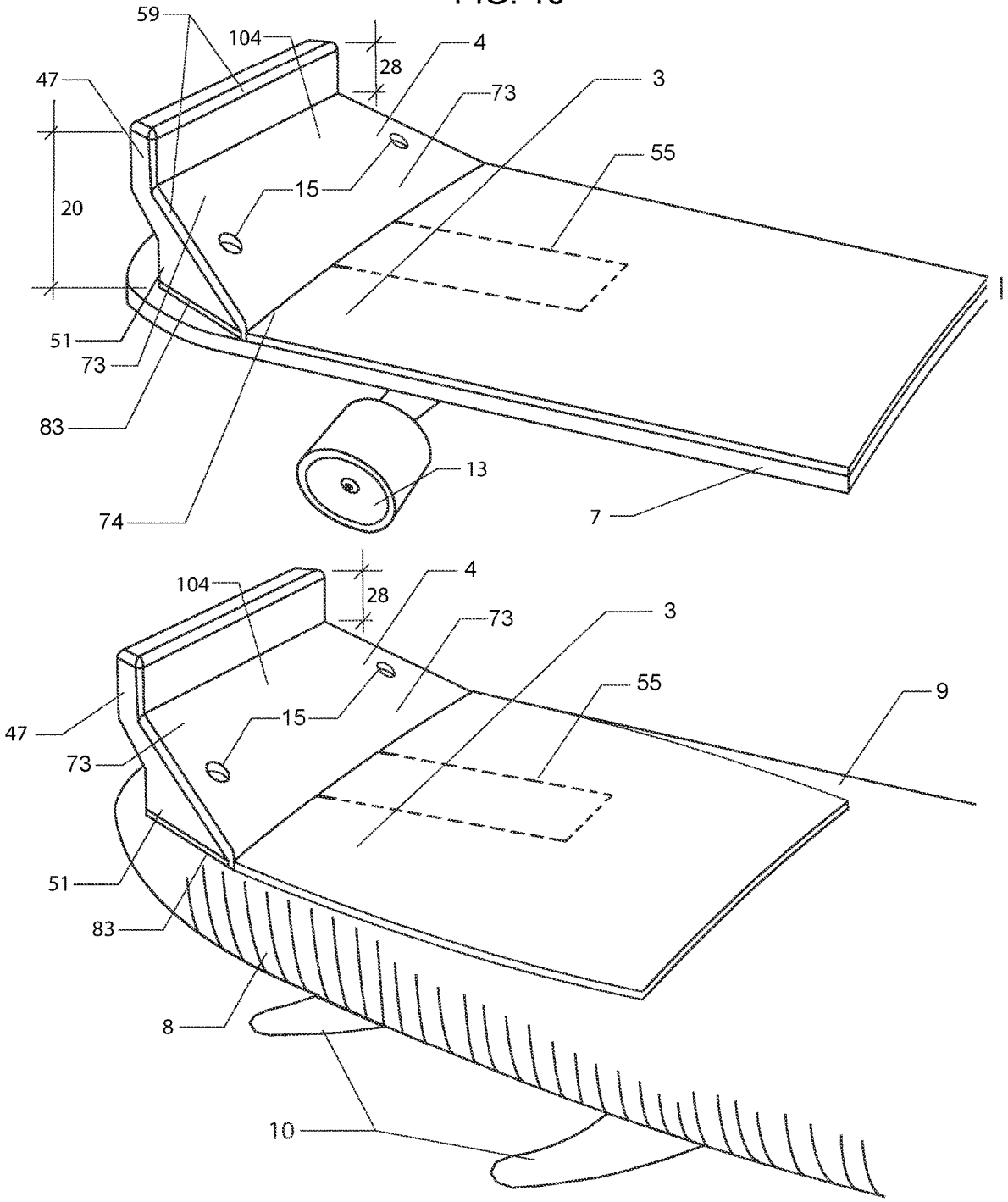
FIG. 10 is a perspective rear view of a 7 skateboard and surfboard equipped with a vertical rise kick tail 51 designed for providing grip with wax.

Referring to FIG. 10, front perspective views of a skateboard 7, 87 and surfboard 8 are shown with a kick tail 51 featuring a vertical rise. Grip is provided for the kick tail 51 with surfboard wax applied to the surface of the kick tail 51, 73. The mounting plate 83 has a tongue 55 for use in securing said mounting plate 83 to the skateboard 7 and surfboard deck 9. Grip for the skateboard and surfboard deck area 7, 9 is provided with traction pad material affixed with adhesive. Traction pad material is shown affixed on top of the tongue in said mounting plate 83 to further secure said mounting plate 83. Said mounting plate 83 is secured to the surfboard deck with adhesive and secured to the skateboard deck with adhesive, glue or nuts and bolts 25.

Figure 11:
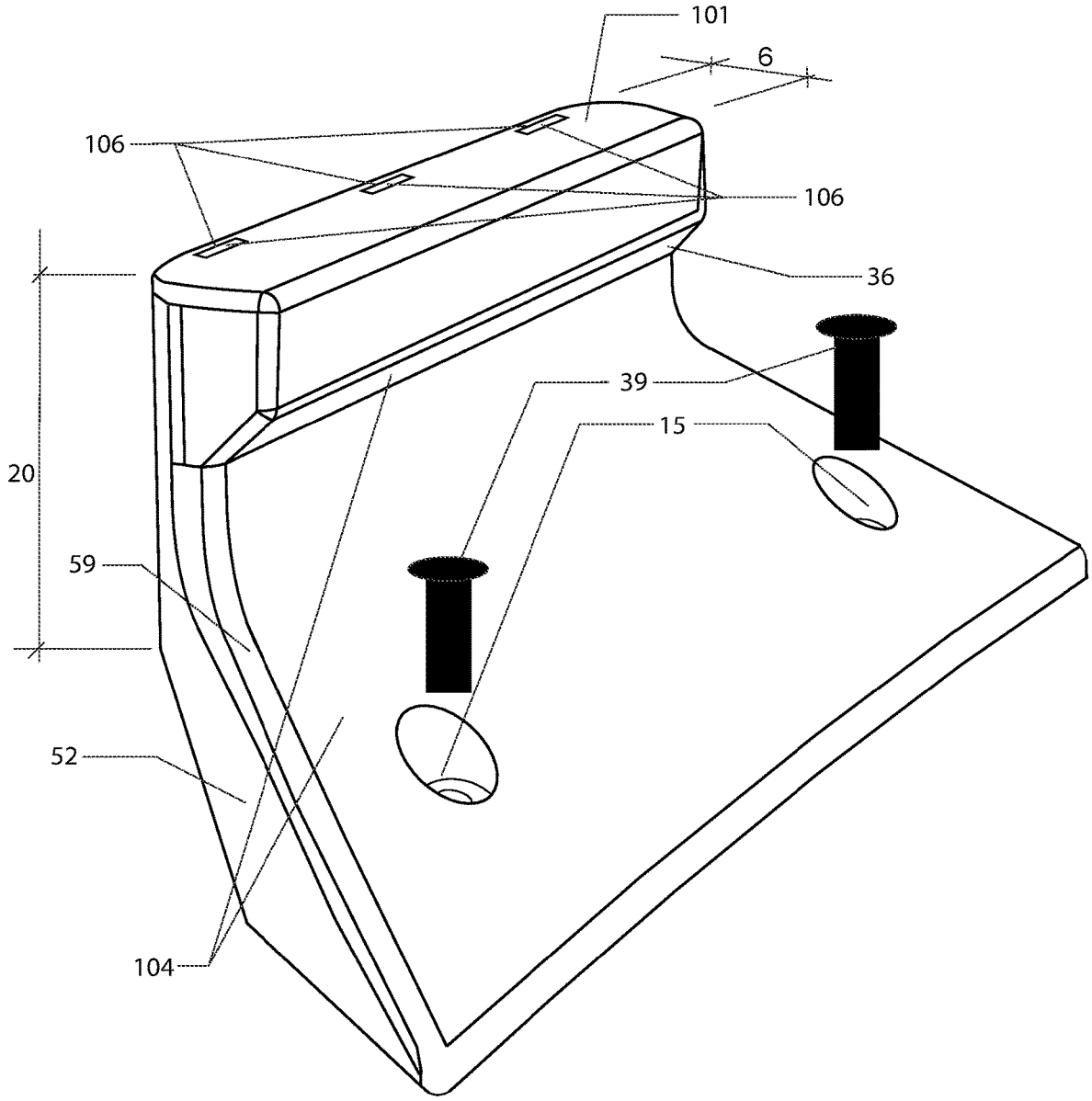
FIG. 11 is a perspective front view of a two piece kick tail designed for providing grip with wax 52, 101 comprising a ramp 4 going into an angled overhang and showing mounting bolts 39.

Referring to FIG. 11, a perspective front view of a kick tail comprising a bottom piece 52 glued to a top piece 101 with an angled overhang designed for providing grip with surfboard wax 104. The Two mounting screws 39 are shown that go through mounting hole 15 which screw into female threaded metal inserts 107 inside barrels 84 into mounting plate 26, 57, 83.

Figure 12:
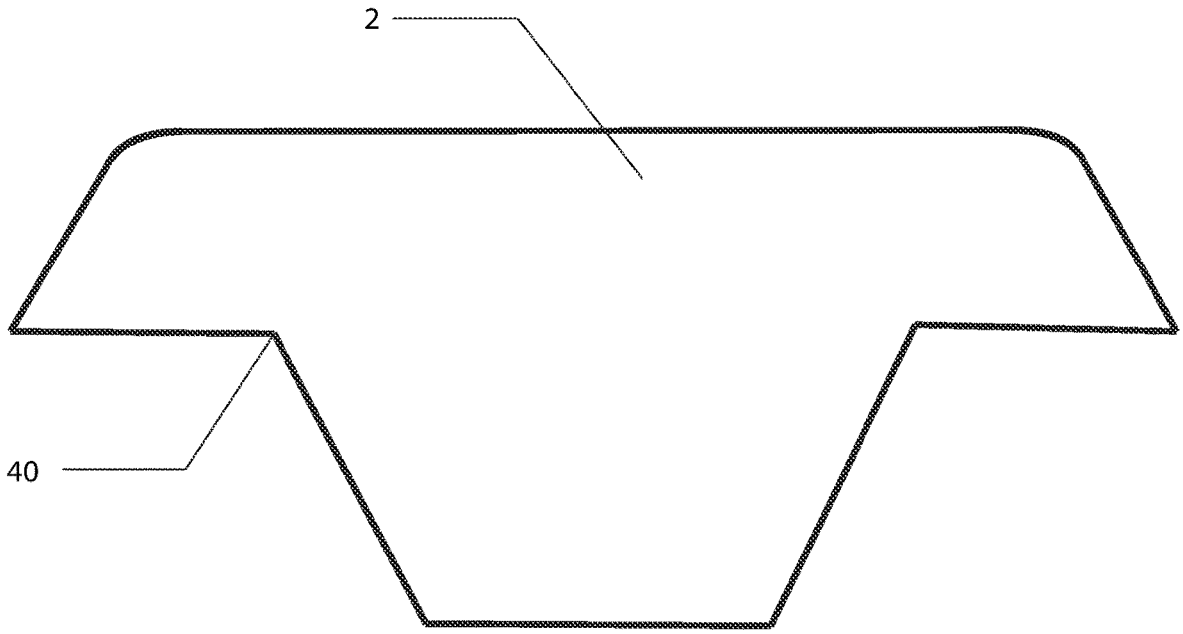
FIG. 12 is a top view of a horizontal overhang top piece 102 showing various ankle cut out options.
Figure 12:
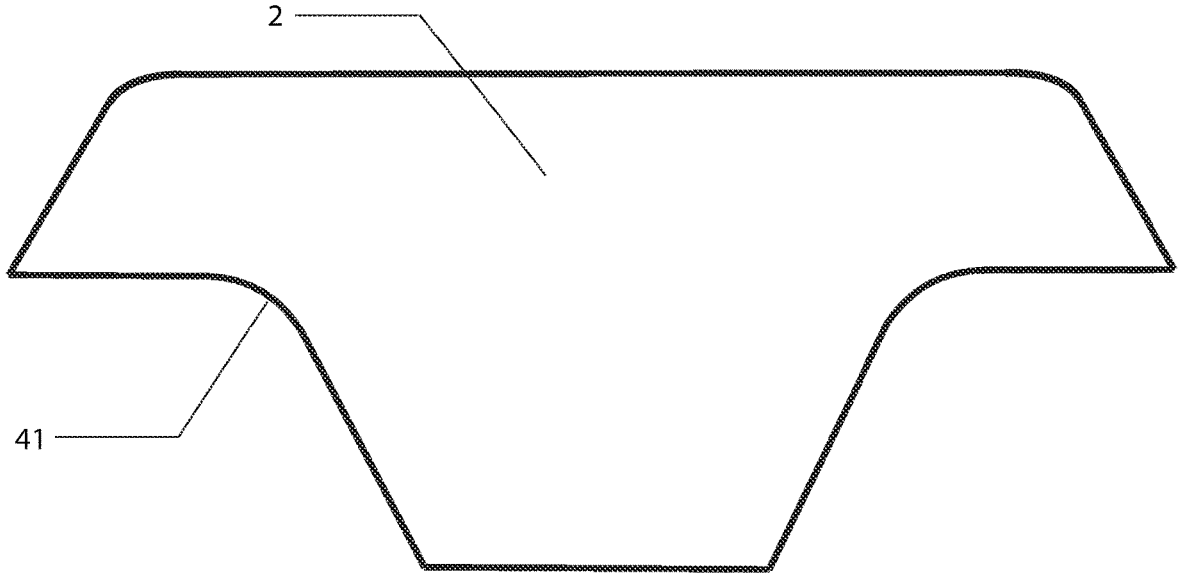

Referring to FIG. 12, a top view of two cut-outs for the skateboarder's ankle is shown.

Figure 13:
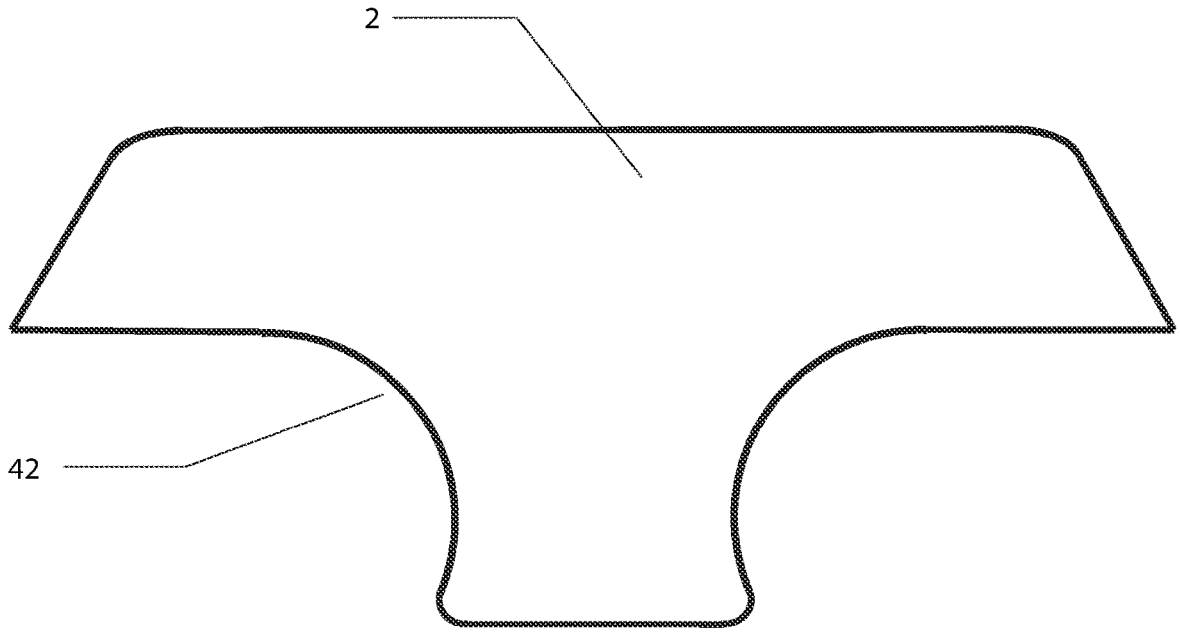
FIG. 13 is a top view of a horizontal overhang top piece 102 showing various ankle cut out options.
Figure 13:
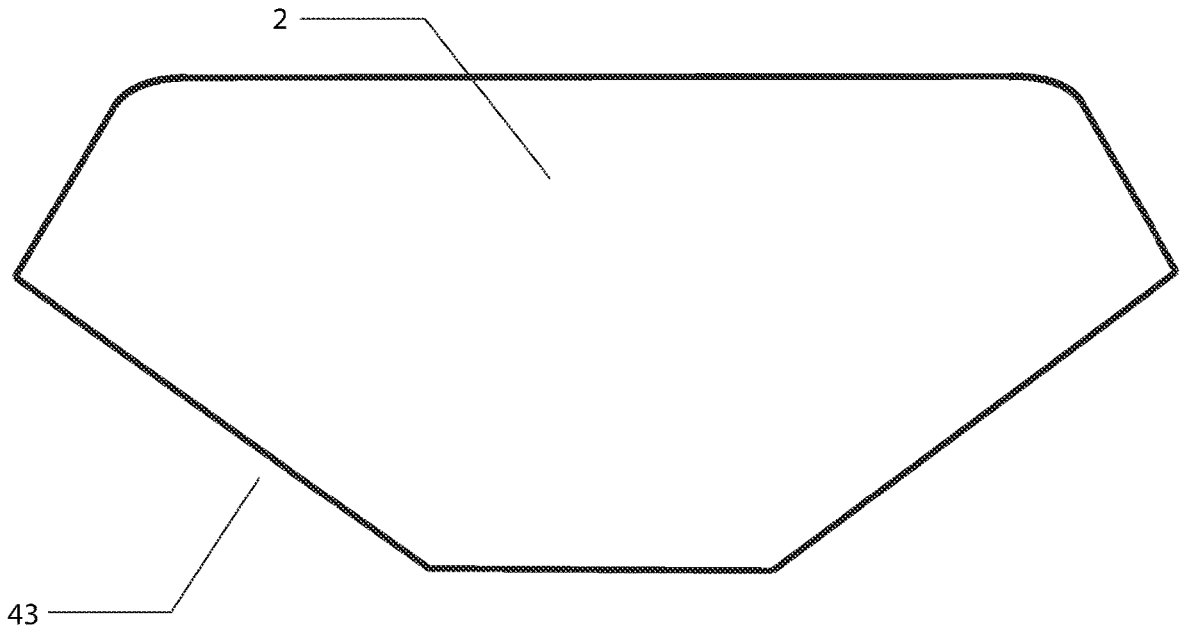

Referring to FIG. 13, a top view of two cut-outs for the skateboarder's ankle is shown.

Referring to FIG. 14, a perspective view of a mounting plate 57 is shown with a cutout 62 for the surfboard leash plug. Said mounting plate 57 has an arched bottom shaped to match the arch in the deck of most surfboards and is made of material that is rigid but flexible enough to easily bend to the shape of the surfboard deck 9 and be flush mounted with adhesive to the surfboard 8, so that no modification to the surfboard is necessary for the mounting plate to achieve a secure and flush fit to the surfboard deck. When mounted to a surfboard, the mounting plate may be affixed with adhesive or glue. When mounted to a skateboard, the mounting plate may be affixed with adhesive, glue or bolts and nuts 25. A mounting plate with a leash cut out is used for mounting kick tails 77, 30, 98, 97, 50, 51, 99, 96 to surfboards but can also be used for mounting kick tails to skateboards. When the mounting plate is made from nylon or plastic, female metal threaded inserts 107 are permanently affixed to the inside of barrels 84 in mounting plate so when screwing screws 39 to attach kick tails, the screws can be screwed tightly without stripping. When the mounting plate is made from cast metal, the barrels are threaded to accept screws 39 for securing kick tails to said mounting plate. Ridges 58 are shown that support barrels 84.

Referring to FIG. 15, a perspective view of a mounting plate 78 is shown without a cutout for the surfboard leash plug and no tongue. Said mounting plate 78 has an arched bottom shaped to match the arch in the deck of most surfboards. When mounted to a skateboard, the mounting plate may be affixed with adhesive, glue or bolts and nuts 25. A mounting plate without a leash cut out 78 is used for mounting kick tails 77, 30, 98, 97, 50, 51, 99, 96 only to skateboards. When the mounting plate is made from nylon or plastic, female metal threaded inserts 107 are permanently affixed to the inside of barrels 84 in mounting plate so when screwing screws 39 to attach kick tails, the screws can be screwed tightly without stripping. When the mounting plate is made from cast metal, the barrels are threaded to accept screws 39 for securing kick tails to said mounting plate. Ridges 58 are shown that support barrels 84.

Figure 16:
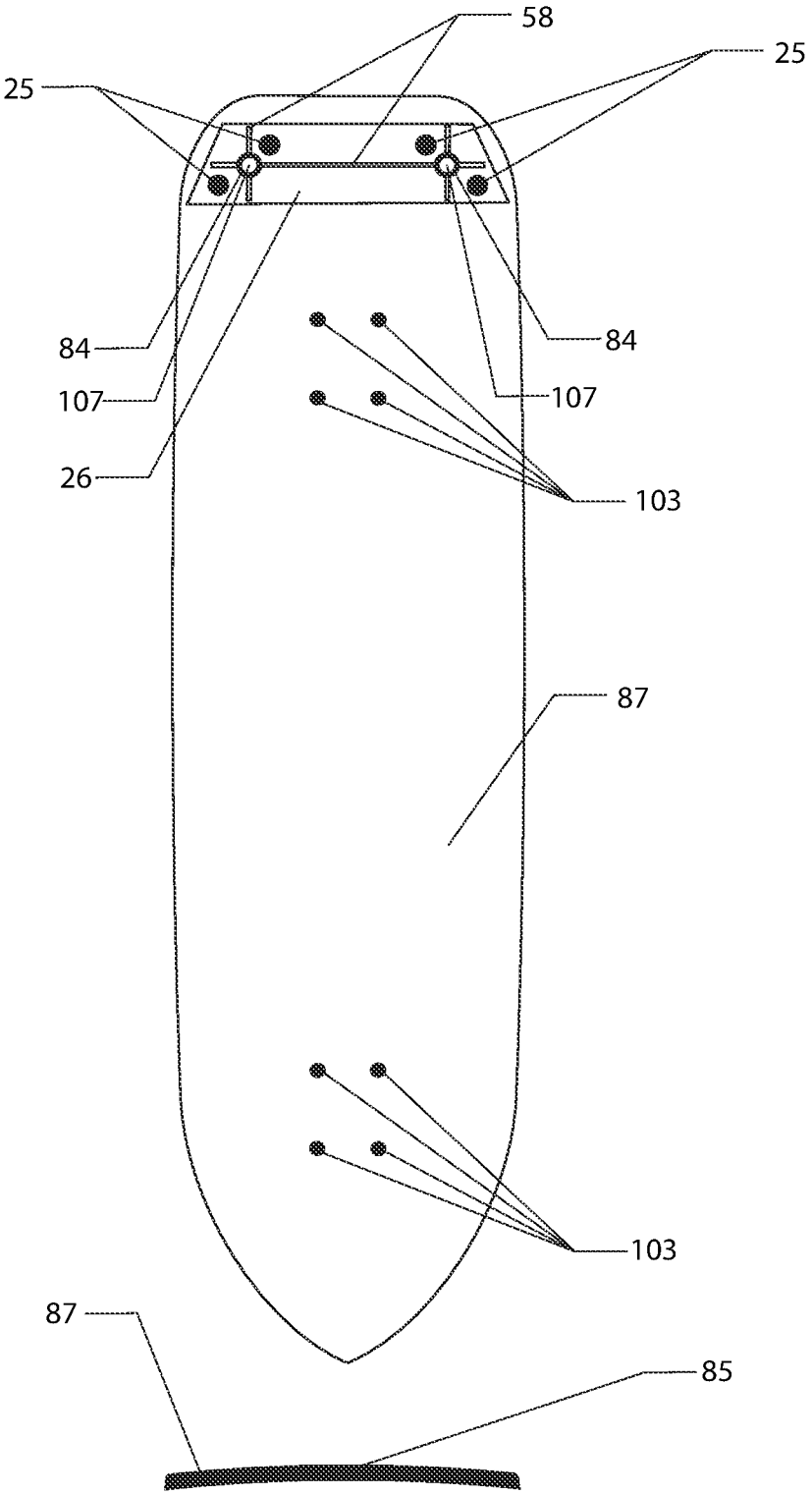
FIG. 16 is a top and front view of a skateboard showing the arch in the deck and the bolts 103 for securing the skateboard trucks to the skateboard deck and bolts 25 for affixing the mounting plate 26 to the skateboard deck.

Referring to FIG. 16, a top view of a skateboard 87 is shown showing possible locations 25 for the bolts that will secure the mounting plate 26 to the skateboard deck. Bolts 103 for securing the skateboard truck assembly are also shown, as is the general shape of the skateboard and arched 85, 87 deck.

Figure 17:
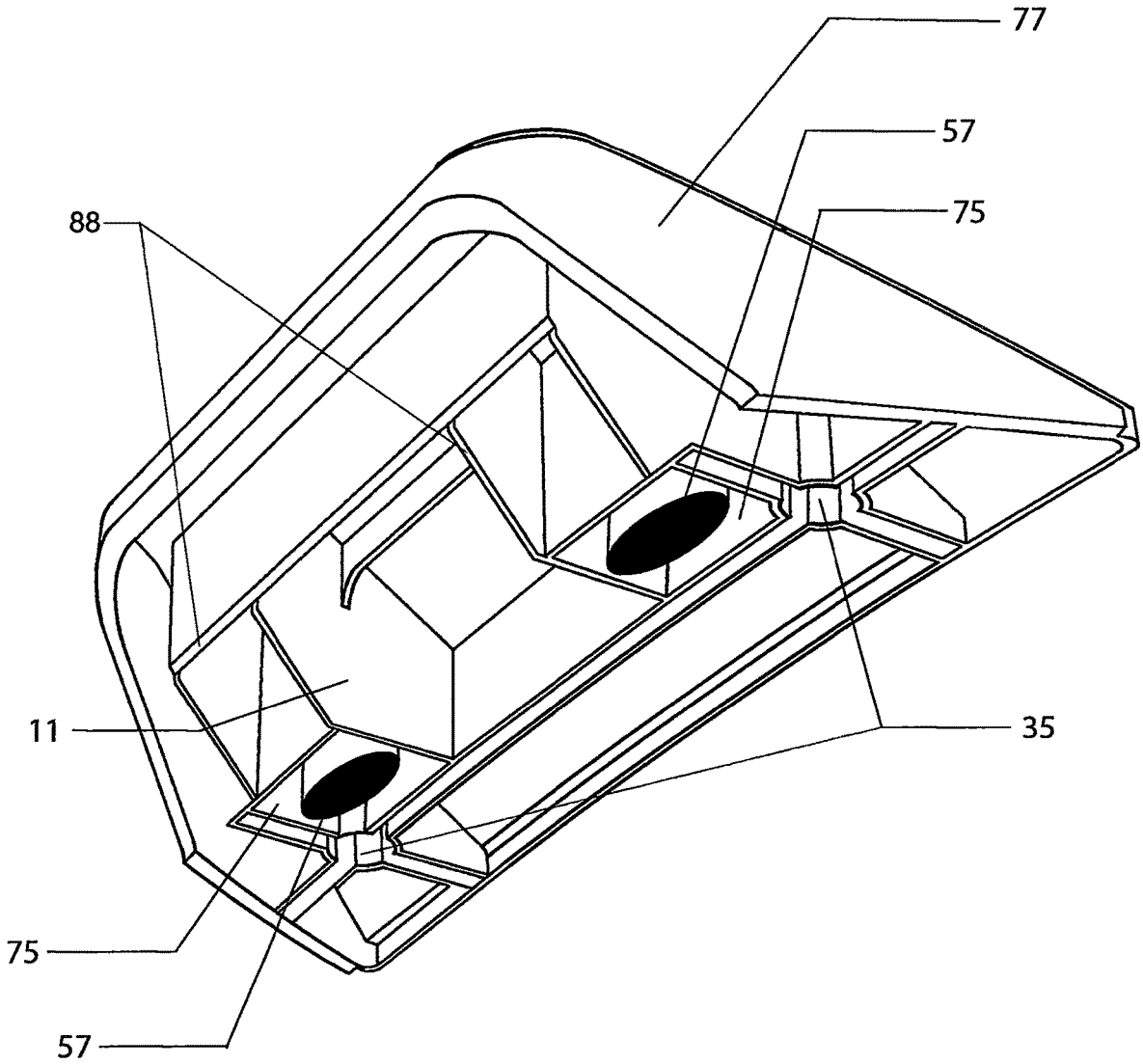
FIG. 17 is a bottom perspective view of a hollow traction pad kick tail for surfboards and skateboards with a ramp 4 going into a flat top 77 showing the ridges for structural support and the area 75 where LED lights 57 are optionally placed.

Referring to FIG. 17, a bottom perspective view is shown of a hollow, flat top 77 kick tail designed to be manufactured with injection molding. In this view the female bottom 35, into which the male threaded barrels 84 and male threaded barrel supports 58 are inserted is visible. A kick tail with a flat top 77 is shown, but all kick tails 77, 30, 98, 97, 50, 51, 99, 96 have a similar underside and when inserted on top of the mounting plate 26, 57, 83, the supporting walls 88 provide a snug fit with the mounting plate ridges 58. Said supporting walls 88 also provide strength to the kick tail so it won't buckle under the weight of the surfer or skateboarder's foot. The supporting walls are so designed that when the kick tail is optionally made from clear material and is affixed to the mounting plate, a sealed chamber 75 is created for waterproof LED lights 57 that illuminate the entire kick tail from the underside.

Figure 18:
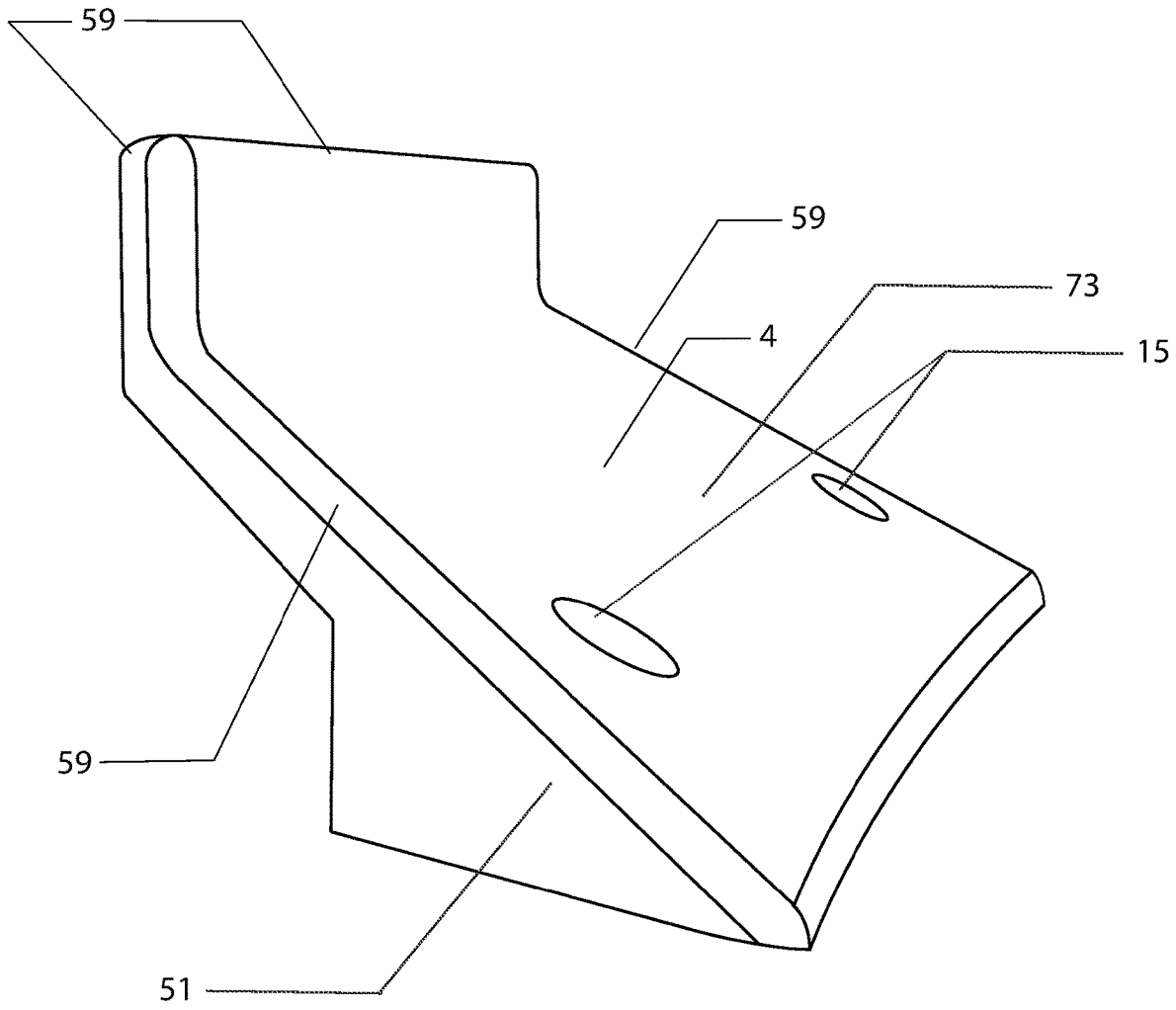
FIG. 18 is a front perspective view of a kick tail with an arched bottom and ramp going into a vertical rise 51 designed for use with wax on the top surface 73 for grip.

Referring to FIG. 18, a top perspective view is shown of a hollow kick tail for surfboards with a ramp 4 going into a vertical rise 51 that is designed to provide grip by wax applied to the surface of the ramp 73. Surfers are used to applying wax to their surfboards for grip. This kick tail and the other kick tails described herein designed for use with wax 50, 99, 96 provide the surfer with the opportunity to feel the wax they are used to under their feet on the kick tail. All kick tails 77, 30, 98, 97, 50, 51, 99, 96 have a similar ramp 4 that is angled at approximately 32 degrees as shown in this patent but can be any angle that provides good support for a surfer's foot. All kick tails 77, 30, 98, 97, 50, 51, 99, 53 have rounded edges 59 in the areas that would come into contact with a surfer's foot for a safer riding experience.

Figure 19:
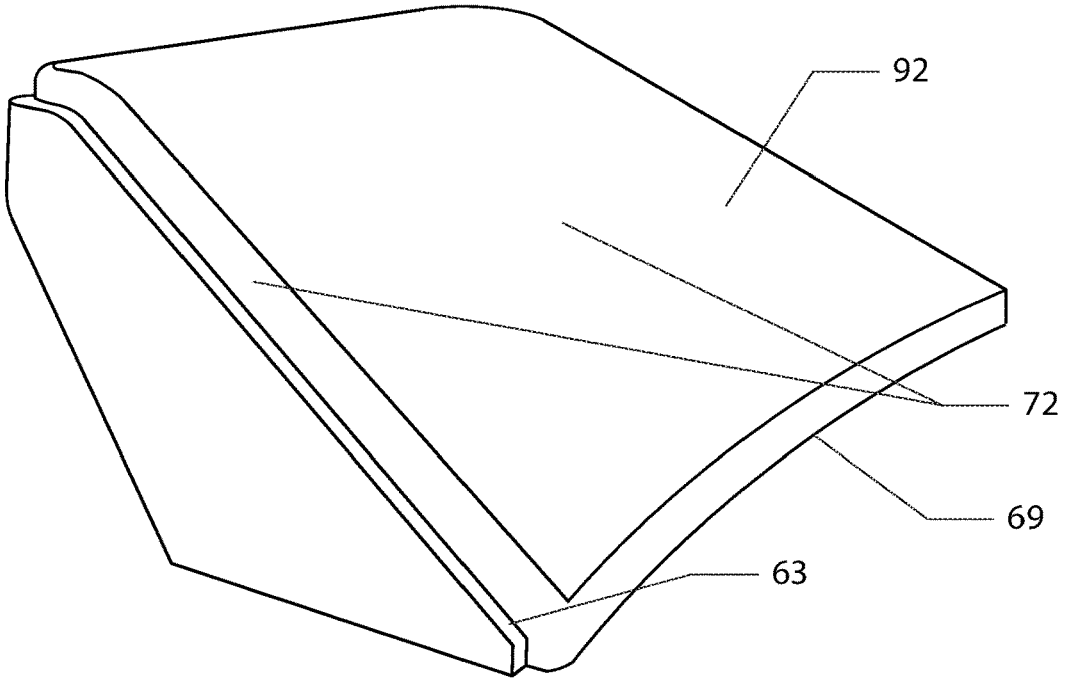
FIG. 19 is a front perspective view of a kick tail with ramp going into a flat top 92 designed for use with a molded traction pad material top piece 56.

Referring to FIG. 19, a front perspective view of a hollow traction pad kick tail with a ramp 4 to flat top 92 is shown designed for a layer of molded traction pad material 56 to be glued to said kick tail and wrapping around the sides to terminate in the recessed area shown 63 with a fit that is flush with the side and back wall of said kick tail. Said traction pad material 56 is designed to fit snugly on top of the kick tail 92. All kick tails that incorporate the use of traction pad material on the ramp, face of vertical rise and/or top piece area 77, 30, 98, 97, 38, 66 have uniquely molded traction pad material designed for a snug fit to whatever kick tail they are paired with.

Figure 20:
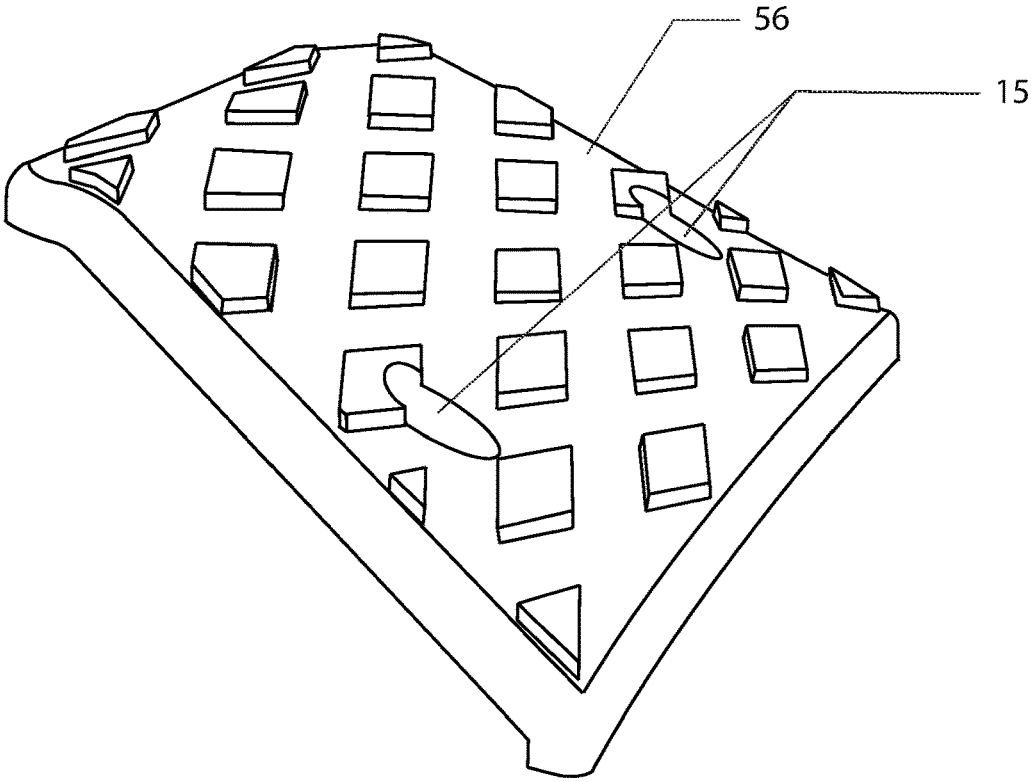
FIG. 20 is a front perspective view of rubber or EVA foam traction pad material 56 molded to fit a kick tail with a ramp going into a flat top 92.

Referring to FIG. 20, a front perspective view of traction pad material 56 molded to fit a flat top kick tail with cut-outs 15 is shown through which mounting screws are inserted.

Figure 21:
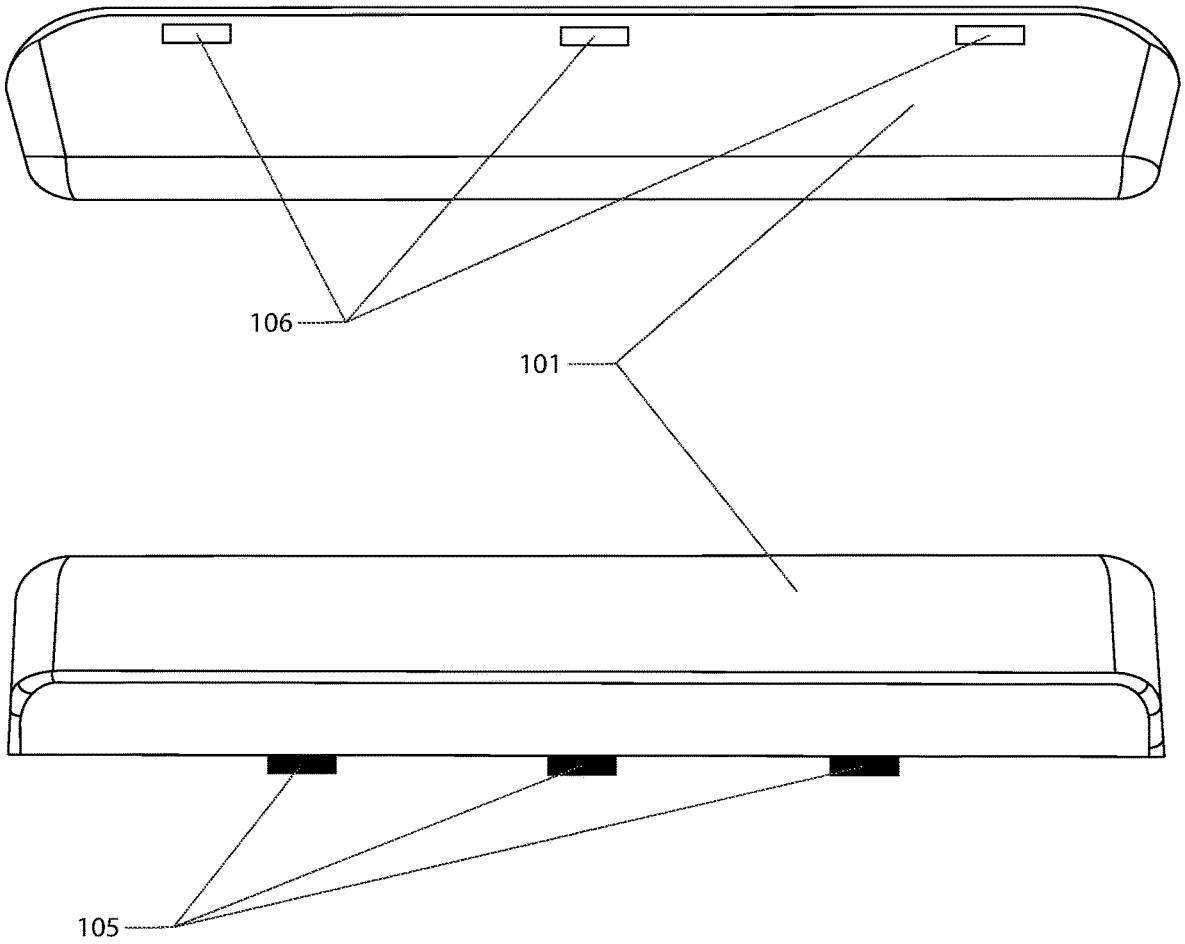
FIG. 21 is a top and front perspective view of the top piece 101 of an angled overhang kick tail showing location of the pegs 105 and slots 106 for affixing to the bottom piece 100.

Referring to FIG. 21, a front perspective view of the top piece 101 of an angled overhang kick tail is shown. Pegs 105 and slots 106 are shown for interlocking said top piece to bottom piece 100.

Figure 22:
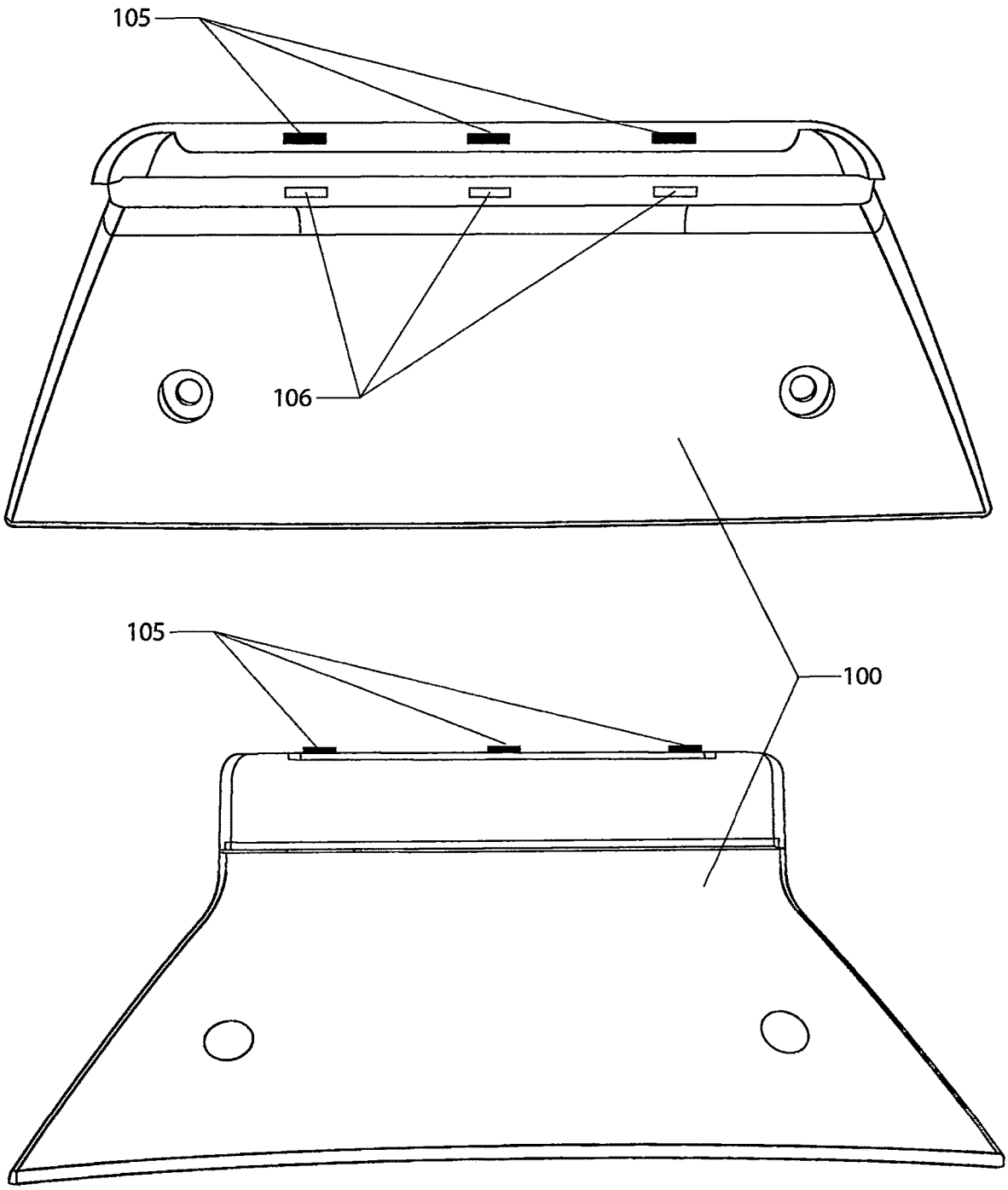
FIG. 22 is a front perspective view of the bottom piece 100 of an angled overhang kick tail designed for use with wax for grip showing location of the pegs 105 and slots 106 for affixing to the top piece 100.

Referring to FIG. 22, a front perspective view of the bottom piece 100 of an angled overhang kick tail is shown. Pegs 105 and slots 106 are shown for interlocking bottom piece 100 to top piece 101.

Figure 23:
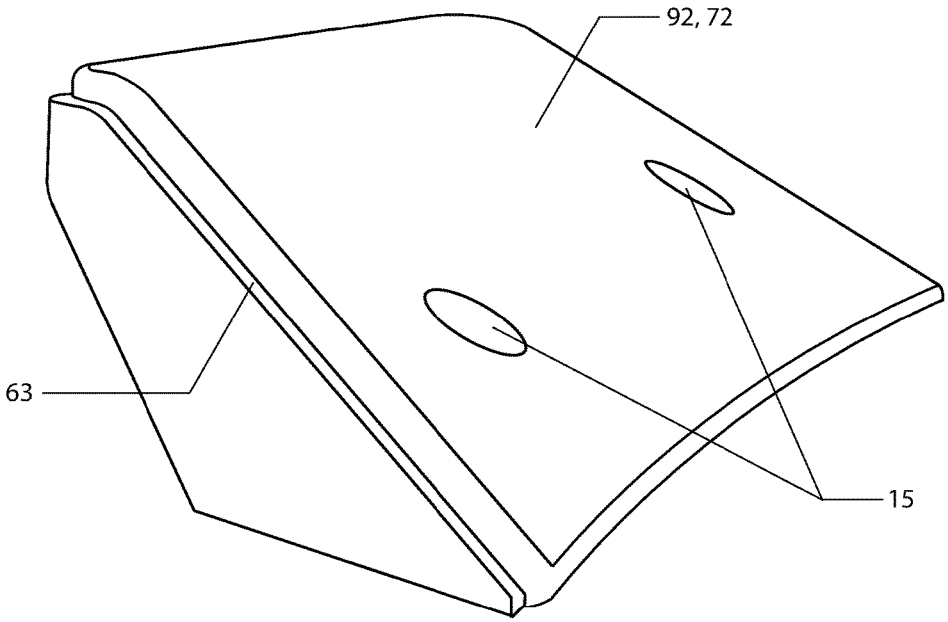
FIG. 23 is a front perspective view of a flat top kick tail designed for use with 92 traction pad material.

Referring to FIG. 23, a front perspective view of a kick tail with a ramp going into a flat top 92 designed for use with traction pad material for grip 72 is shown. No traction pad material is shown on the kick tail 92 so the design of how the traction pad material fits into the kick tail 63 can be viewed. The area onto which traction pad material is glued to the ramp area is shown 72. Traction pad material is to be glued to the face of the ramp area and over the edges 63. Edges are rounded for safety 59. Holes 15 for screws 39 that affix said kick tail 92 to mounting plate are shown.

Figure 24:
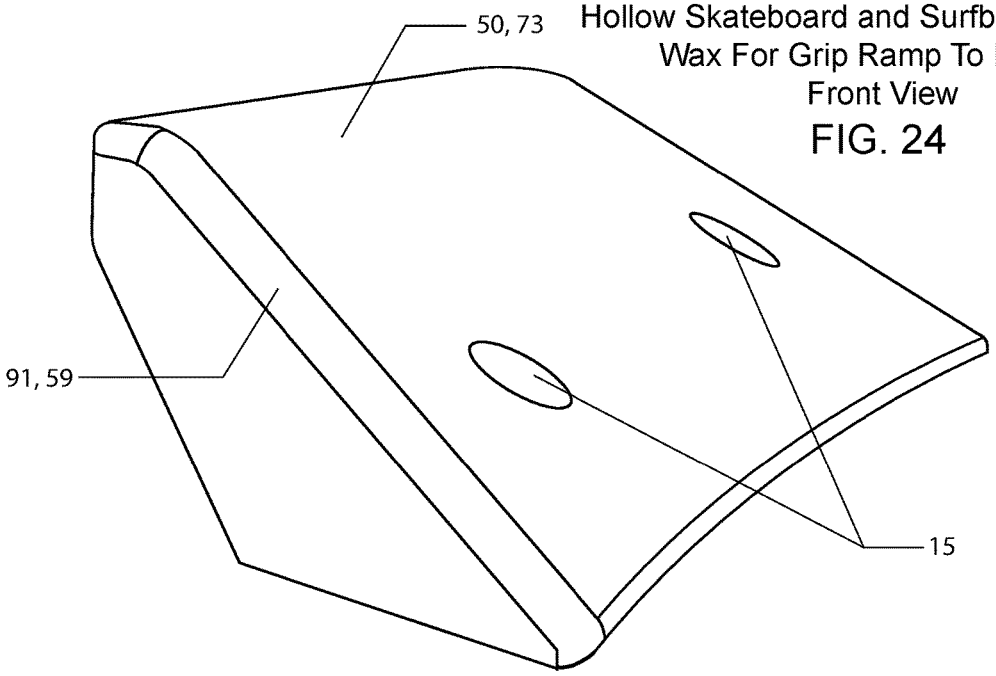
FIG. 24 is a front perspective view of a flat top kick tail designed for use with wax for grip.

Referring to FIG. 24, a front perspective view of a kick tail with a ramp going into a flat top designed for use with wax for grip is shown. Edges are rounded for safety 59, 91. Holes 15 for screws 39 that affix the kick tail 53 to mounting plate are shown.

Figure 25:
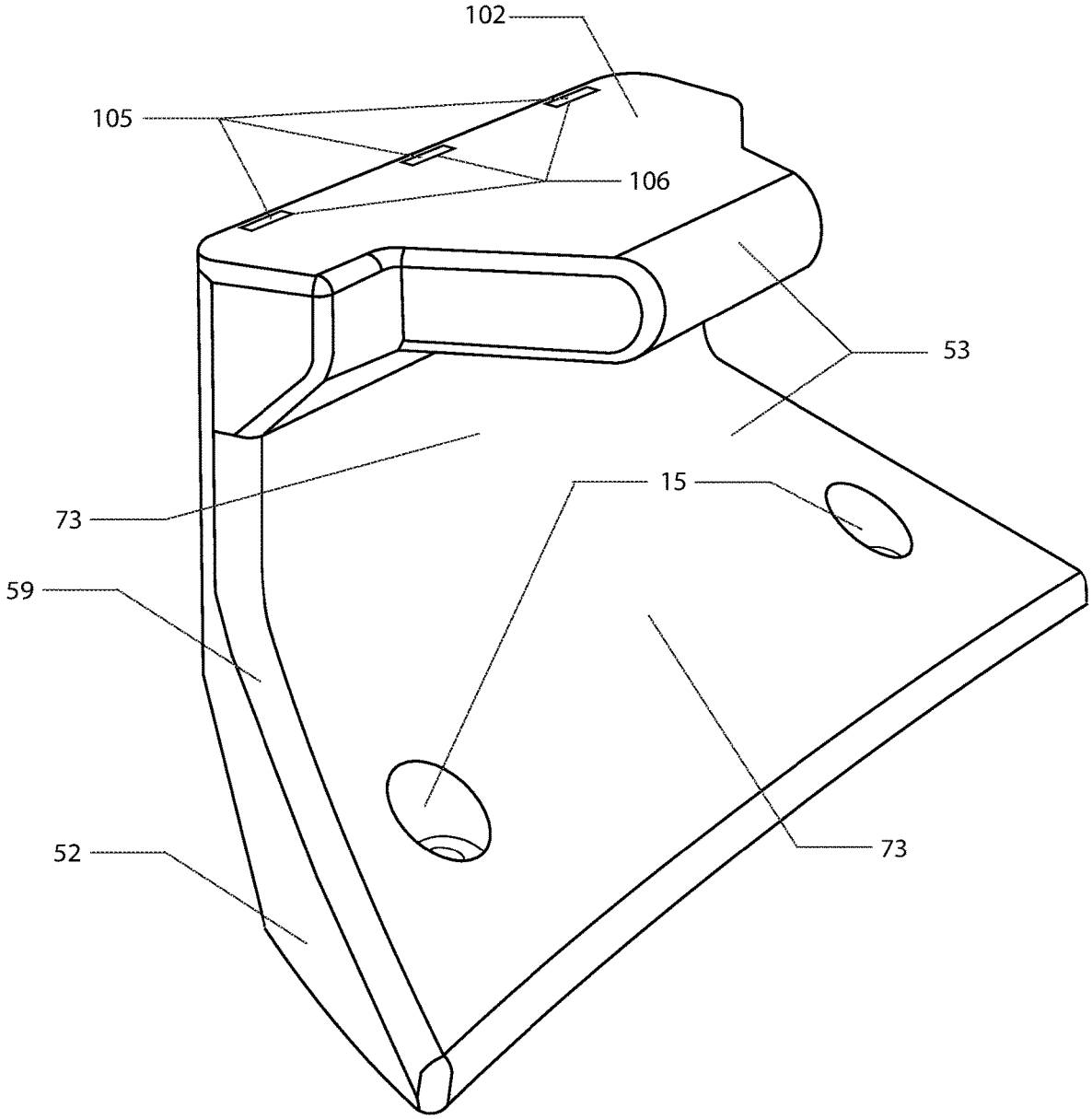
FIG. 25 is a front perspective view of a two piece 52, 102 kick tail with ramp going into a horizontal overhang designed for use with wax for grip.

Referring to FIG. 25, a front perspective view of the two pieces 52, 102 that comprise a kick tail with a horizontal overhang designed for use wax for grip is shown. The top piece 102 is glued to the bottom piece 52 resting on supports molded into the bottom piece 64, 67. Edges are rounded for safety 59. Pegs 105 and slots 106 are shown for interlocking said top piece to bottom piece 52.

Glossary of Numbered Description

1 Kick tail with ramp going into a horizontal overhang for use with traction pad material
2 Top piece with horizontal overhang
3 Traction pad material 5
4 Traction pad foot ramp angled at approximately 32 degrees from the horizontal skateboard or surfboard deck
5 Screw for attaching top piece
6 Overhang can be any length
7 Skateboard deck
8 Surfboard
9 Surfboard deck
10 Surfboard fins
11 Leash pin cut-out
12 Advertising area for logo and branding
13 Skateboard wheels
14 Overhang
15 Mounting holes
16 One piece traction pad
17 Kick tail traction pad material
18 Vertical rise of traction pad can be any length
19 Kick tail vertical section
20 Kick tails can be any height
21 Width of kick tail can be any length
22 Width of angled area to horizontal overhang can be any length
23 Top of kick tail can be any width
24 Distance from bottom of kick tail to underside of overhang can be any length
25 Bolts for securing mounting plate to skateboard deck
26 Arched mounting plate without tongue
27 Recessed area for traction pad material
28 Vertical rise of one piece base with no overhang can be any length
29 Horizontal Overhang
30 Kick tail with ramp going into a vertical rise designed for use with traction material affixed to face
31 Surfboard leash pin hole
32 Skateboard deck
33 Vertical front of angled overhang
34 Angled overhang top piece
35 Female opening for inserting and securing male mounting plate
36 Angular overhang
37 Skaters right (Rear) foot (regular foot stance)
38 Bottom piece for kick tails with ramp going into angled and horizontal overhang designed for use with traction pad material affixed to the ramp and vertical rise area
39 Mounting screws
40 Angled ankle cut out
41 Curved ankle cut out
42 Curved ankle cut out
43 Angled ankle cut out
44 Pin for securing left side of top piece
45 Raised traction area can be square, rhombus or any other shape and thickness
46 Horizontal screw shaft for securing top piece to base
47 Vertical face of kick tail at top of ramp
48 Traction pad material molded for a snug fit to a vertical rise kick tail
49 Vertical front of base at top of ramp
50 Hollow kick tail with ramp going into a flat top for use with surfboard wax for traction
51 Hollow kick tail with ramp going into a vertical rise for use with surfboard wax for traction
52 Hollow kick tail bottom piece for angled and horizontal overhang top pieces for use with surfboard wax for traction
53 Hollow two piece kick tail with horizontal overhang comprising bottom piece glued to top piece for use with surfboard wax for traction
54 Angled overhang top piece
55 Mounting plate tongue
56 Traction pad material molded to fit top of kick tail
57 Waterproof LED light and battery
58 Male barrel support ridge
59 Rounded corners and edges
60 Hollow kick tail with ramp going into a vertical rise designed for use with traction material affixed to face
61 Arched base bottom
62 Optional cut-out for surfboard leash pin
63 Recess for rubber or EVA foam traction material
64 Top piece affixes to bottom piece here
65 Arched mounting plate bolted into skateboard deck
66 Angled overhang top piece
67 Supporting lip for top piece
68 Foot pocket area
69 Arched bottom to fit flush with the deck of a typical surfboard
70 Skateboard truck
71 Top piece in two piece vertical rise kick tail
72 This is where a molded traction pad material top piece will be affixed
73 This is where the surfboard wax is applied for traction in lieu of traction pad material
74 Traction pad material cut line where traction pad material affixed to the deck begins
75 Specially designed space for LED lighting under kick tail
76 Horizontal top can be any width
77 Kick tail with ramp going into flat top for use with traction pad material
78 Mounting plate without leash pin cut out
79 Traction pad material molded to fit a vertical rise kick tail
80 Single Piece traction pad for base to skateboard deck attachment
81 Multiple piece traction pad for base to skateboard deck attachment
82 Support lip for top piece to be glued to
83 Arched mounting plate with tongue
84 Male barrel in mounting plate
85 Front view of skateboard deck showing arch typical of arch in a surfboard
86 Transition area in skateboard going from flat to curved deck surface
87 Unique shape of a skateboard with arched deck to match the arch in a typical surfboard deck
88 Structural support ridge on underside of kick tail
89 Mounting plate and kick tail arch can be any height
90 Traction pad material created by a mold that fits snugly on top of a kick tail

91 Edge of kick tail wraps around smoothly for use with surfboard wax
92 Hollow kick tail with ramp going into a flat top designed for use with molded traction pad material
93 Top piece in two piece horizontal overhang kick tail designed for use with surfboard wax for grip
94 Arched mounting plate
95 Traction pad material molded to fit kick tail bottom or top piece
96 Hollow two piece kick tail comprising bottom piece glued to top piece for use with surfboard wax for traction
97 Hollow two piece kick tail with horizontal overhang comprising a bottom piece that is glued to top piece designed for use with traction pad material
98 Hollow two piece kick tail with an angled overhang comprising a bottom piece that is glued to top piece for use with traction pad material
99 Hollow two piece kick tail with angled overhang comprising a bottom piece that is glued to top piece for use with surfboard wax for traction
100 Angled overhang bottom piece designed for use with wax for grip kick tail
101 Angled overhang top piece designed for use with wax for grip kick tail
102 Top piece in two piece horizontal overhang kick tail
103 Bolts for securing trucks to skateboard deck
104 Surfboard wax applied to this area for grip
105 Pegs to fit in slots in top piece
106 Slots into which top piece pegs fit into
107 Female threaded metal insert

The invention claimed is:

1. A traction system comprising interchangeable hollow kick tails 77, 30, 98, 97, 50, 51, 99, 53, rigid but flexible mounting plates 26, 83 and traction pad material 3, 95 for mounting to the deck of a surfboard 8 and a specially designed skateboard 7, 87, the bottom of said kick tails, mounting plate and skateboard 7, 87 uniquely designed to have the same arch as the arched deck in a typical surfboard so that mounting plates 26, 83 affix the hollow kick tails to surfboards and said skateboard with screws for a flush mount, with grip for the surfer and skateboarder's foot achieved by either traction pad material or surfboard wax, with hollow kick tails for use with traction pad material including a ramp going into a flat top 77, a ramp going into a vertical rise 30, a ramp going into an angled overhang 98, and a ramp going into a horizontal overhang 97 with traction pad material 3, 95 affixed to the surface of said kick tails 77, 30, 98, 97 where the skateboarder and surfer's foot would come into contact with by glue or adhesive, and hollow kick tails designed for achieving grip with surfboard wax including a ramp going into a flat top 50, a ramp going into a vertical rise 51, a ramp going into an angled overhang 99, and a ramp going into a horizontal overhang 53 with surfboard wax applied to the surface of said kick tails for grip 73, and in designs used for achieving grip with traction pad material and those designed for achieving grip with surfboard wax, additional traction pad material extending forward beginning at the front of the kick tail 74 towards the nose of the skateboard 87 and surfboard 8 and affixed to the skateboard 87 and surfboard 8 with adhesive, so that with a mounting plate 26, 83 installed on both the surfboard and skateboard, the skateboarder can remove an interchangeable kick tail 77, 30, 98, 97, 50, 51, 99, 53 from their skateboard 87 and mount it on their surfboard 8 and remove the interchangeable kick tail 77, 30, 98, 97, 50, 51, 99, 53 from their surfboard 8 and mount it on their skateboard 87.

2. The traction system of claim 1 comprises kick tails 77, 30, 98, 97, 50, 51, 99, 53 that are mounted to a specially designed skateboard 7, 87 and surfboard 8 with a rigid and flexible mounting plate 26, 83 made from plastic or nylon for surfboards and made from plastic, nylon or metal for skateboards fixed to the surfboard deck with adhesive and affixed to the skateboard deck with adhesive or glue and optionally with bolts and nuts 25, and said mounting plate 26, 83 for both surfboards and skateboards 7, 87 having male barrel supports 58 and male barrels 84 which extend up and are inserted into the female opening on the underside of said kick tails 35, said male barrels when made from nylon or plastic having threaded female metal inserts 107 permanently affixed to the inside of said barrels into which screws 39 are screwed from the top of said kick tails into said metal inserts 107 which secure said kick tails to said mounting plate 26, 83 and when said mounting plate is made from metal for use with a skateboard, said barrels are optionally manufactured with threads that accept screws 39 used to secure said mounting plate to said kick tails, said mounting plate having a bottom that is arched to match the curvature in the deck of typical surfboards so that no modification of a surfboard is necessary for a flush installation of said mounting plate 26, 83 to a surfboard because either the mounting plate has an arch that matches the arch of the surfboard deck or because said mounting plate is flexible enough to be bent to match the arch in said surfboard deck and when mounted to a skateboard 7, 87, the deck of the skateboard 7, 87 is arched to match the arch in said mounting plate 26, 83 and said mounting plate 26, 83 has an optional tongue 55 that extends forward which provides more surface area for the adhesive securing said mounting plate to the surfboard and skateboard deck which creates a stronger bond between said mounting plate and the surfboard and skateboard deck, and when traction pad material 3 is affixed to the deck of the surfboard and skateboard, said tongue 55 is affixed under said traction pad material 3 to keep said mounting plate secure and practically impossible to come off of said surfboard and skateboard deck when bonded to the deck of said surfboard or skateboard with suitable adhesive, and when a mounting plate 26, 83, is installed on a surfboard or skateboard with adhesive, said mounting plate may be removed in the event the surfboard becomes unusable and re-mounted on another surfboard with new adhesive affixed to the underside of said mounting plate, and when the mounting plate is installed on a skateboard with either adhesive or bolts 25 said mounting plate may be removed in the event that the skateboard becomes unusable and installed on another skateboard with new adhesive affixed to the underside of said mounting plate or by affixing the mounting plate to the skateboard using bolts if that was the original installation method.

3. The traction system of claim 1 includes hollow kick tails 77, 30, 98, 97, 50, 51, 99, 53 which are made from rigid and flexible material as deemed necessary for structural integrity, functionality, and ease of manufacturing, and the bottom of said kick tails is arched to match the arch in the mounting plate 26, 83, said kick tails having a female opening on their underside into which the male components 58, 84 of the mounting plate 26, 83 are inserted for a snug fit, and said kick tails are secured in place by screws 39 screwed from the top through holes 15 in said kick tails into female threaded metal inserts 107 permanently affixed inside said barrels 84, and said kick tails are designed for use with molded traction pad material 56, 79 to be glued to the top surface for grip 7, 30, 98, 97, 72 or for surfboard wax to be applied to the top surface for grip 50, 51, 99, 53, 73 for the surfer and skateboarder's foot, and in the case where the mounting plate 26, 83 is made from metal, rather than using separate threaded inserts 107, said mounting plate will be manufactured with female threaded barrels into which screws 39 are inserted to hold kick tails in place.

4. The traction system of claim 1 kick tails are manufactured in different sizes and heights 6, 18, 20, 21, 22, 23 so a surfer and skateboarder's entire rear foot of any size can reside comfortably on the ramp 4 or in the foot pocket area 68 created by the vertical rise with any combination of an angular, or horizontal overhang with optimum clearance between the top of said foot and the bottom of the overhang so the skater and surfer can maintain a secure point of contact with the skateboard and surfboard and push the tail of the skateboard and surfboard back with the side of said foot and/or lift the tail end of the skateboard and surfboard up with the top of said foot and have an ankle cut out 40, 41, 42, 43 so designed to allow the skateboarder and surfer's rear foot to have freedom of movement without being constrained by said overhang and also so that the skateboarder and surfer's rear foot can come out of the foot pocket area easily if and when the skater and surfer falls off of the skateboard or surfboard when skateboarding or surfing.

5. The traction system of claim 1 kick tails 77, 30, 98, 97, 50, 51, 99, 53 are made out of nylon, rubber, plastic, metal, or any other material having flex and rigidity which will retain it's form while pressure from the skateboarder and surfer's rear foot pushes against the ramp 4 and/or back of the foot pocket area 68, or lifting against the underside of the foot pocket area with pressure from the top of the said foot, and are hollow so the weight of said kick tails will be as low as possible and are manufactured with any color including material that is clear, the underside of said kick tails so configured to provide a space 75 for optionally installed waterproof LED lights with an integrated battery 57 which are secured in place when the kick tails are screwed on to the mounting plate, and shine through the kick tails thereby illuminating said kick tails from the underside.

6. The traction system of claim 1, wherein the traction pad material 3 comprising EVA rubber foam or some other material or combination of materials, has a surface for making it easy to grip with the skateboarder and surfer's foot without slipping, is permanently affixed to the front face of the kick tails 30, 77, 97, 98, with adhesive, with additional traction pad material 3 extending forward beginning at the front of said kick tails 74 towards the nose of the skateboard and surfboard, affixed to the skateboard and surfboard with adhesive, as far as is needed to provide optimum traction for the skateboarder and surfer's rear foot while skateboarding or surfing, and said traction pad material 3 may be different for the kick tail than for the traction pad material extending forward from the front of the kick tail, and may be different for the center piece than the sides and may be different from piece to piece anywhere in any manner including having an area arched or flattened for a logo or tread design to be affixed or imprinted and traction pad material 3 can be in any color or combination of colors.

7. The traction system of claim 1, wherein the kick tails 77, 30, 98, 97, 50, 51, 99, 53 are uniquely designed to display a product name, and/or an advertising message with or without a logo on the front, back or side vertical space and/or on the ramp area 4 or on the top horizontal space 12 with said product name, logo and/or advertising message optionally molded, carved and/or stamped with permanent ink, or the product name, and/or an advertising message with or without a logo may be displayed with a separate piece of material affixed with adhesive.

8. The traction system of claim 1, wherein the skateboard is made from wood, metal, fiberglass, plastic or any other material that provides suitable rigidity and flexibility for skateboarding and is suitably prepared by sanding, planing or initial shaping of the skateboard 87 to create a surface area to which the traction pad material will adhere.

9. The traction system of claim 1, wherein the traction pad material 3 is configured to have a separation point 74 at the bottom of the ramp 4 between the front of the kick tail 77, 30, 98, 97, 50, 51, 99, 53 and the beginning of the traction pad material affixed to the skateboard and surfboard deck 3, so said kick tail can be easily removed for swapping with other kick tails while the traction pad material 3 affixed to the skateboard and surfboard deck 7 remains undisturbed.

10. The traction system of claim 1, wherein the skateboard deck 7, mounting plate 26, 83 and kick tail bottom 69 are all arched to match the curvature in the deck of typical surfboards, so the mounting plate affixes flush to the skateboard deck and all kick tails 77, 30, 98, 97, 50, 51, 99, 53 affix flush to the mounting plate for a snug and secure fit, and when said mounting plate is affixed to a surfboard deck, even if said mounting plate has to bend slightly to fit the surfboard, the design is such that when the female opening on the underside of the kick tail is inserted into the male components 58, 84 of the mounting plate 26, 83 and screwed together with mounting screws 39 the fit will be flush and secure.

11. The traction system of claim 1, wherein the kick tails 77, 30, 98, 97, 50, 51, 99, 53 have a ramp area 4 that is manufactured at angle from the horizontal skateboard and surfboard deck between 30 and 40 degrees, or as wide as is needed so the skateboarder or surfer's rear foot is completely supported when attempting any maneuver.

12. The traction system of claim 1, wherein the kick tails 77, 30, 98, 97, 50, 51, 99, 53 are configured to have rounded edges 59 where necessary to provide safety for skateboard and surfboard riders and sharp edges that may cause injury upon contact with the skateboarder or surfer when falling or otherwise using their skateboard or surfboard that might cause injury are eliminated.

13. The traction system of claim 1, wherein the kick tails 50, 51, 99, 53 are secured to the mounting plate 26, 83 by screws 39 which is affixed to a skateboard 7 or surfboard deck 9 with no traction pad material on said kick tail or on said surfboard or skateboard deck, 9 with grip provided entirely by surfboard wax applied to the surface of the kick tail and surfboard or skateboard that would come into contact with a surfer or skateboarder's foot.

14. The traction system of claim 1 is unique in that it is the first traction system comprising mounting plates 26, 83 and kick tails 77, 30, 98, 97, 50, 51, 99, 53 that are interchangeable between surfboards and the uniquely designed skateboard as specified herein, so said kick tails can be removed from the skateboarder's skateboard and mounted on their surfboard, and then removed from their surfboard and mounted on the their skateboard so the skateboarders can feel with their feet what they feel when surfing and are able to practice surfing turns and maneuvers with more accuracy than ever before, the first interchangeable kick tail for a surfboard 8 that can be affixed to the surfboard 8 by adhesive using a mounting plate 26, 83 that requires no modification to the surfboard, and the first interchangeable kick tail for a surfboard or skateboard that can provide grip with surfboard wax 50, 51, 99, 53 and the first kick tail for surfboards and skateboards that is configured to have optional waterproof LED lights secured under the kick tails when said kick tails are secured by screws into the mounting plate 26, 83 thereby illuminating said kick tails from the underside.

* * * * *